US007712801B2

(12) United States Patent
Xu et al.

(10) Patent No.: US 7,712,801 B2
(45) Date of Patent: May 11, 2010

(54) ROTARY PAWL LATCH

(75) Inventors: Jianping Xu, Min Hang District (CN); David A. Minnich, Lincoln University, PA (US); Camillo R. Conte, Newark, DE (US); Kevin A. McCloskey, Hatboro, PA (US); Ryan M. Downey, Phoenixville, PA (US); Martin M. Morrison, West Chester, PA (US)

(73) Assignee: Southco, Inc., Concordville, PA (US)

( * ) Notice: Subject to any disclaimer, the term of this patent is extended or adjusted under 35 U.S.C. 154(b) by 0 days.

(21) Appl. No.: 11/840,214

(22) Filed: Aug. 16, 2007

(65) Prior Publication Data

US 2008/0042450 A1 Feb. 21, 2008

Related U.S. Application Data

(60) Provisional application No. 60/838,250, filed on Aug. 16, 2006.

(51) Int. Cl.
*E05C 3/06* (2006.01)
*E05C 3/16* (2006.01)

(52) U.S. Cl. ..... 292/216; 292/98; 292/108; 292/111; 292/DIG. 37

(58) Field of Classification Search ..... 292/216, 292/DIG. 37, 98, 111, 108
See application file for complete search history.

(56) References Cited

U.S. PATENT DOCUMENTS

| | | | | |
|---|---|---|---|---|
| 2,828,151 | A * | 3/1958 | Brotman et al. | 292/144 |
| 3,036,453 | A * | 5/1962 | Dubonnet | 70/207 |
| 4,177,656 | A * | 12/1979 | Davis | 70/84 |
| 5,927,772 | A | 7/1999 | Antonucci et al. | |
| 6,048,006 | A | 4/2000 | Antonucci et al. | |
| 6,120,069 | A * | 9/2000 | Taranto | 292/35 |
| 6,581,988 | B1 * | 6/2003 | Mihail | 292/216 |
| 6,742,818 | B2 * | 6/2004 | Seki et al. | 292/216 |
| 6,761,382 | B2 | 7/2004 | Ji et al. | |
| 6,896,302 | B2 * | 5/2005 | Belchine et al. | 292/336.3 |
| 7,004,517 | B2 | 2/2006 | Vitry et al. | |
| 7,065,992 | B2 | 6/2006 | Talukdar et al. | |
| 7,185,927 | B2 | 3/2007 | Talukdar et al. | |
| 7,341,300 | B2 | 3/2008 | Miller et al. | |
| 7,347,460 | B2 * | 3/2008 | Ala | 292/216 |
| 2003/0025339 | A1 | 2/2003 | Vitry et al. | |
| 2003/0193199 | A1 | 10/2003 | Talukdar et al. | |
| 2004/0012468 | A1 | 1/2004 | Hyp | |
| 2005/0067840 | A1 | 3/2005 | Koveal et al. | |
| 2007/0216173 | A1 | 9/2007 | Vitry | |

FOREIGN PATENT DOCUMENTS

| | | | |
|---|---|---|---|
| WO | WO0138671 | A2 | 5/2001 |
| WO | WO2006034057 | A1 | 3/2006 |

* cited by examiner

*Primary Examiner*—Carlos Lugo
(74) *Attorney, Agent, or Firm*—Paul & Paul

(57) ABSTRACT

A rotary pawl latch has a lock bar that engages with the pawl when the pawl is latched and that moves toward the center of the pawl to release the pawl for unlatching. This lock bar never completely becomes disengaged from the envelope of the pawl. There are cutouts in the pawl which allow the pawl to rotate as the lock bar is actuated.

17 Claims, 35 Drawing Sheets

110

110

110

110

110

110

118
138
138
118
126
104
126
118
118
138
104
138

104

118
104
118
126
138
138
126
118
118

104

104

100
102
122
130

100
130
122
106
110
138
102
104

100
102
130
122
106
110
104
138

116

116

116

116

116

116

Fig. 57
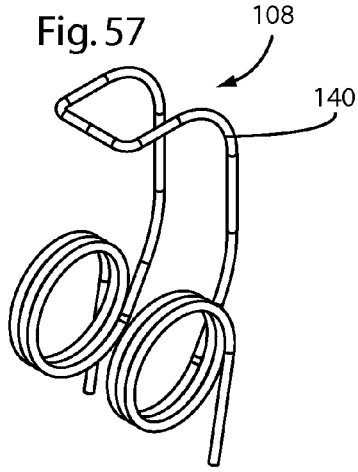
Fig. 58
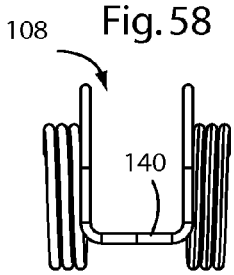
Fig. 59
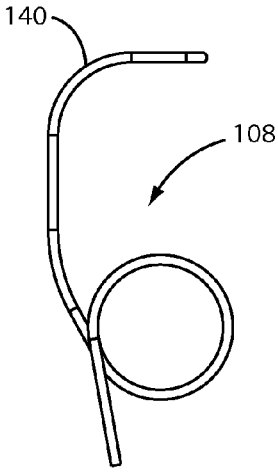
Fig. 60
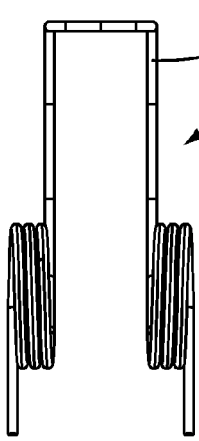
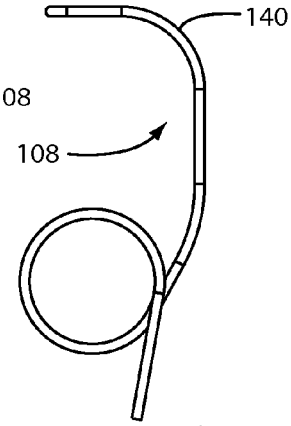
Fig. 61
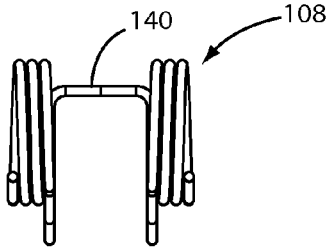
Fig. 62

310

310

310

310

310

310

310

ROTARY PAWL LATCH

CROSS REFERENCE TO RELATED APPLICATIONS

This application claims the benefit of the priority of United States Provisional Application for patent Ser. No. 60/838,250, filed on Aug. 16, 2006, the entirety of which is incorporated herein by reference.

BACKGROUND OF THE INVENTION

1. Field of Invention

The present invention relates to the field of latches.

2. Brief Description of the Related Art

Latches are relied on in many applications for securing, for example, doors in a closed position. Although many latches are known in the prior art, none are seen to teach or suggest the unique features of the present invention or to achieve the advantages of the present invention.

SUMMARY OF THE INVENTION

The present invention is directed to a rotary pawl latch that has a lock bar that engages with the pawl when the pawl is latched and that moves toward the axis of rotation of the pawl to release the pawl for unlatching. This lock bar never completely becomes disengaged from the envelope of the pawl. There are cutouts in the pawl which allow the pawl to rotate as the lock bar is actuated.

BRIEF DESCRIPTION OF THE DRAWINGS

FIGS. 1-62 are views of a first embodiment of a rotary pawl latch according to the present invention.

DETAILED DESCRIPTION OF THE INVENTION

Figure 1:
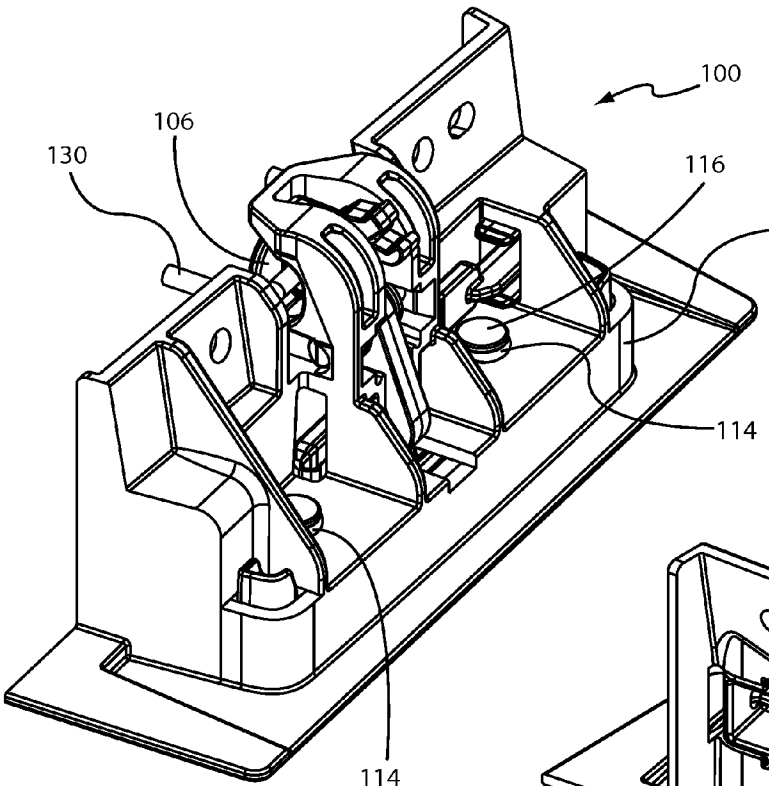
Figure 2:
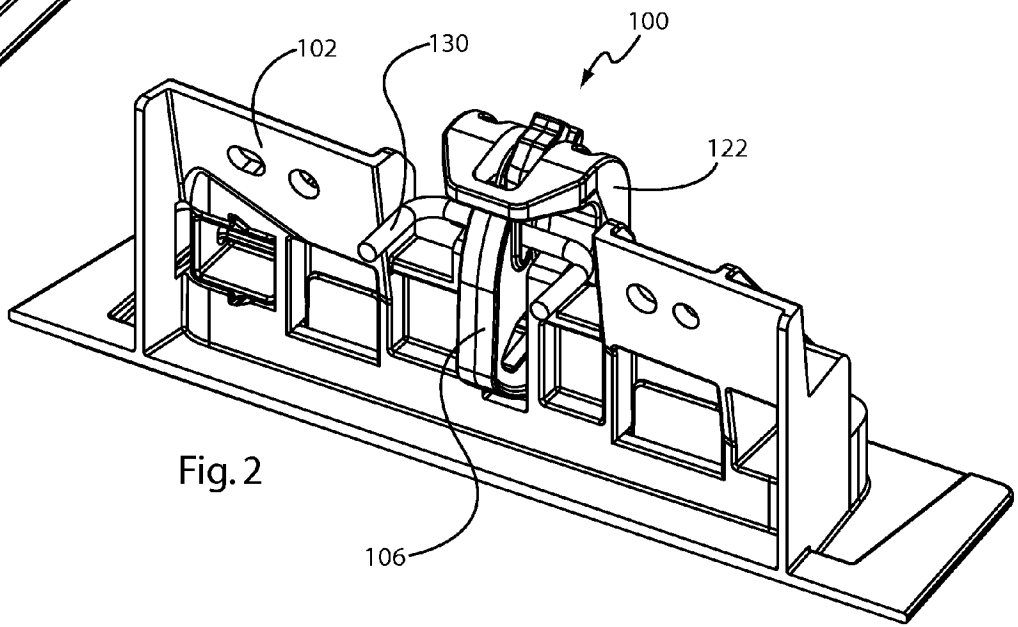
Figures 3, 4, 5, 6, 7:
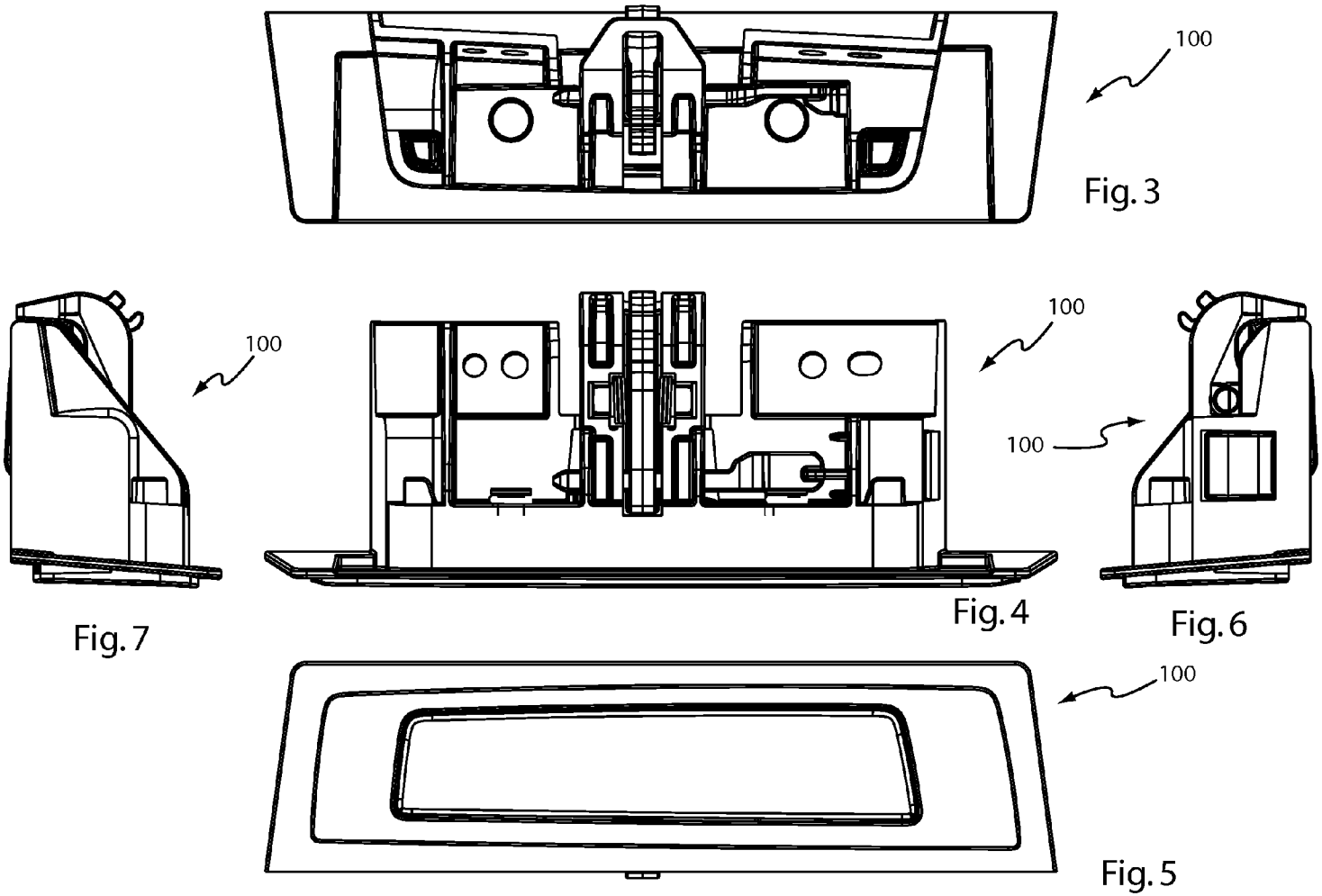
Figures 8, 9, 10:
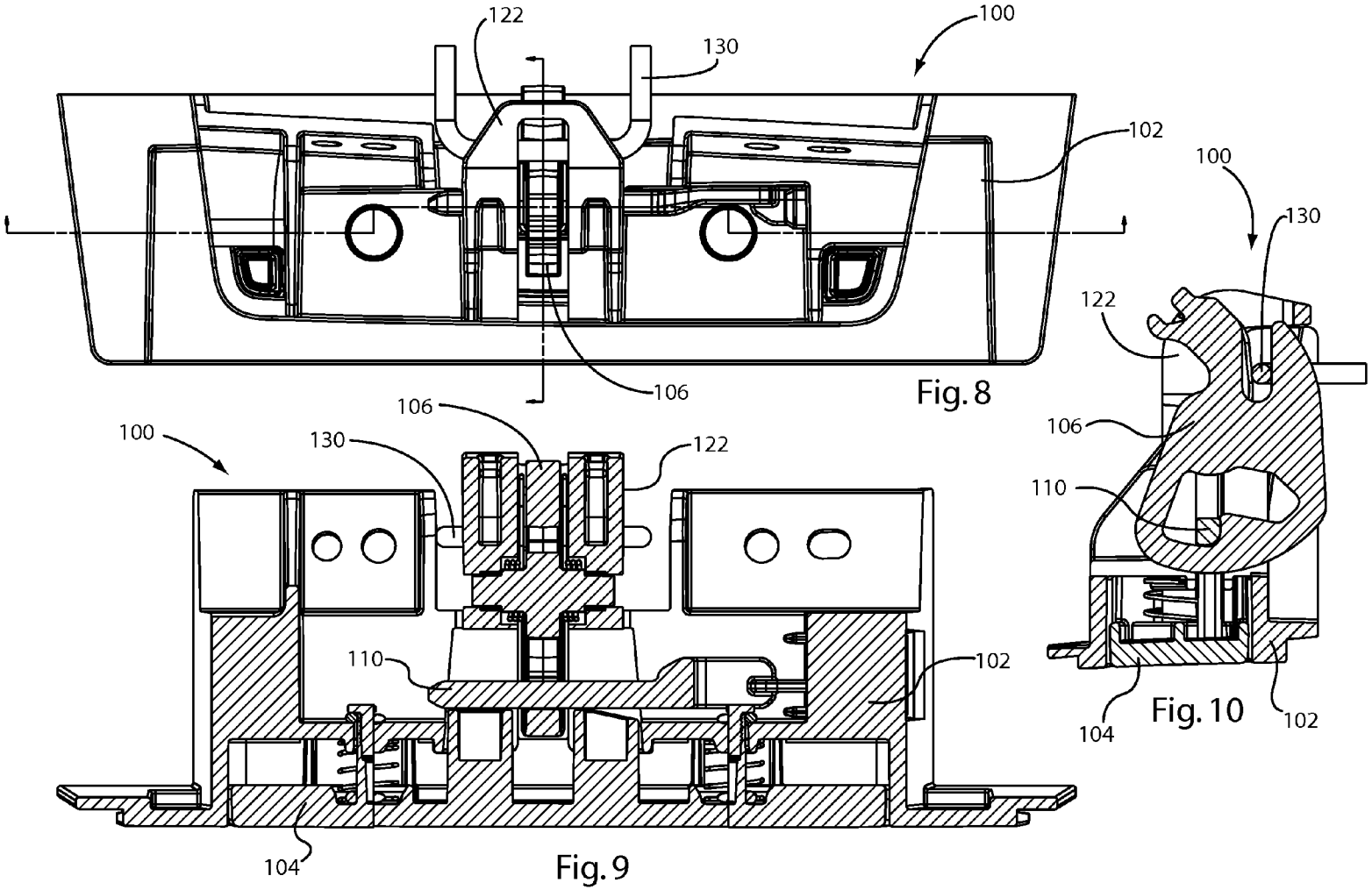

Two embodiments 100 and 300 have been designed. Both utilize the same basic new pawl mechanism, which has a lock bar engaged with the pawl when latched that moves toward the center of the pawl to release the pawl for unlatching. This lock bar never completely becomes disengaged from the envelope of the pawl. There are cutouts in the pawl which allow the pawl to rotate as the lock bar is actuated. As can be readily seen in FIGS. 9, 10, 27, 28, 37, 38, 52, 53, 55, 56, 77-80, 91-95, 97-98, and 100-101, the lock bar 110, 310 is positioned to extend through the lock bar slot 124 of the pawl, also referred to as a cutout, at all times during operation of the rotary pawl latch. A step of the pawl that is engaged by the lock bar to keep the pawl in the latched position is formed by the inner profile of the lock bar slot. Both embodiments use a push button user interface to actuate the lock bar. The main advantage realized with this new pawl release mechanism is the ability to have a compact package space for the pawl and lock bar, which in turn enables the whole latch to be made smaller than prior rotating pawl glove box latches. One difference between both embodiments is the direction the striker moves with respect to the latch, and correspondingly the orientation of the rotating pawl within the latch. Another slight difference is in the cutouts of the pawl. In embodiment 100 the pawl does not completely rotate to the open position when the button is fully depressed so that the striker does not fully become free of the pawl until the button is released. In embodiment 300, the pawl does completely rotate when the button is fully depressed. The differences in geometry of the cutout or lock bar slot results from the desire to make the pawl as strong as possible by minimizing the cutout area in the pawl of embodiment 100. Another difference between the two embodiments is in how the push button operates. The embodiment 100 is a relatively simple version that has two plunger legs under the button and rides on two cylindrical compression springs. The button is trapped by fasteners on the far ends of the plunger legs. O-rings on the plungers cushion the button as its stroke bottoms out in both depressed and extended positions. In the embodiment 300, the button rides on two torsion springs to help minimize stroke noise. Additionally, it also has long bayonet legs to help guide the button from cocking as it is depressed. Further, it also has living spring leg features around the top periphery of the button to help keep the top of the button centered within the housing. The pawl mechanism common to the two embodiments can be used in combination with a variety of mechanisms for actuating the lock bar, as evidenced by the two exemplary embodiments 100 and 300. The pawl mechanism may also be used with a lift handle for actuation, and such a combination is contemplated as being within the scope of the present invention.

The First Embodiment

The embodiment 100 of the Rotary Pawl Latch consists of a housing 102, a button 104 with integrated guide rails 118, a pawl 106, a Pawl Torsion Spring 108, a Lock bar 110, one or more Button Compression Springs 112, O-rings 114, 136 or Grommet bumpers (not shown), and one or more Push studs 116.

In assembly, the Pawl Torsion Spring 108 is assembled around the Pawl posts 120 and this subassembly is then snapped into the Housing 102. The Lock bar 110 can then be slid in from the side of the housing 102 and through both the central tower 122 of the housing and the lock bar slot 124 of the Pawl 106. The button 104 along with the button springs 112 are installed in the housing 102 with the integrated guide rails 118 providing some constraint in both location and movement of the button 104. O-rings 114, 136 are situated on the centerline guide posts 126 of the Button 104 that extend through bores 128 in the housing 102. Push studs 116 are installed into the Button guide posts 126 to keep the entire assembly together. Alternatively, designs can be made using a set of grommets installed into the housing 102 in lieu of the O-rings 114, 136 on the button 104, and variations exist using snap in features in lieu of the push studs 116.

In the "latched" position (e.g. shown in FIG. 10), the pawl torsion spring 108 biases the pawl 106 toward the unlatched position (e.g. shown in FIG. 28) and forces the pawl 106 against the lock bar 110, and the striker 130 is fully constrained between the throat 132 of the pawl 106 and the housing tower 122. The lock bar 110 in turn is held in double shear against the central tower 122 of the housing 102 and the stepped portion 134 of the pawl 106. The button 104 is biased by springs 112 to the outward-most position (e.g. shown in FIG. 27) with the O-rings 114 bottoming out on the housing 102 to maintain the position of the button 104. The center ribs 138 of the button 104 are positioned just adjacent the lock bar 110 and are almost in contact with it as e.g. illustrated in FIGS. 9 and 10. The lock bar 110 is positioned generally intermediate the center ribs 138 and the axis of rotation of the pawl 106 defined by pawl posts 120. The pawl spring 108 also has a loop 140 that engages the pawl 106 on one side of the opening of the throat 132 of the pawl 106 to bias the pawl 106 toward the unlatched position. The loop 140 also extends along a portion of the throat 132 of the pawl 106 to put some preload on the striker 130. This helps reduce the Buzz, Squeak, and Rattle issues related to the striker/pawl interface.

Figures 26, 27, 28:
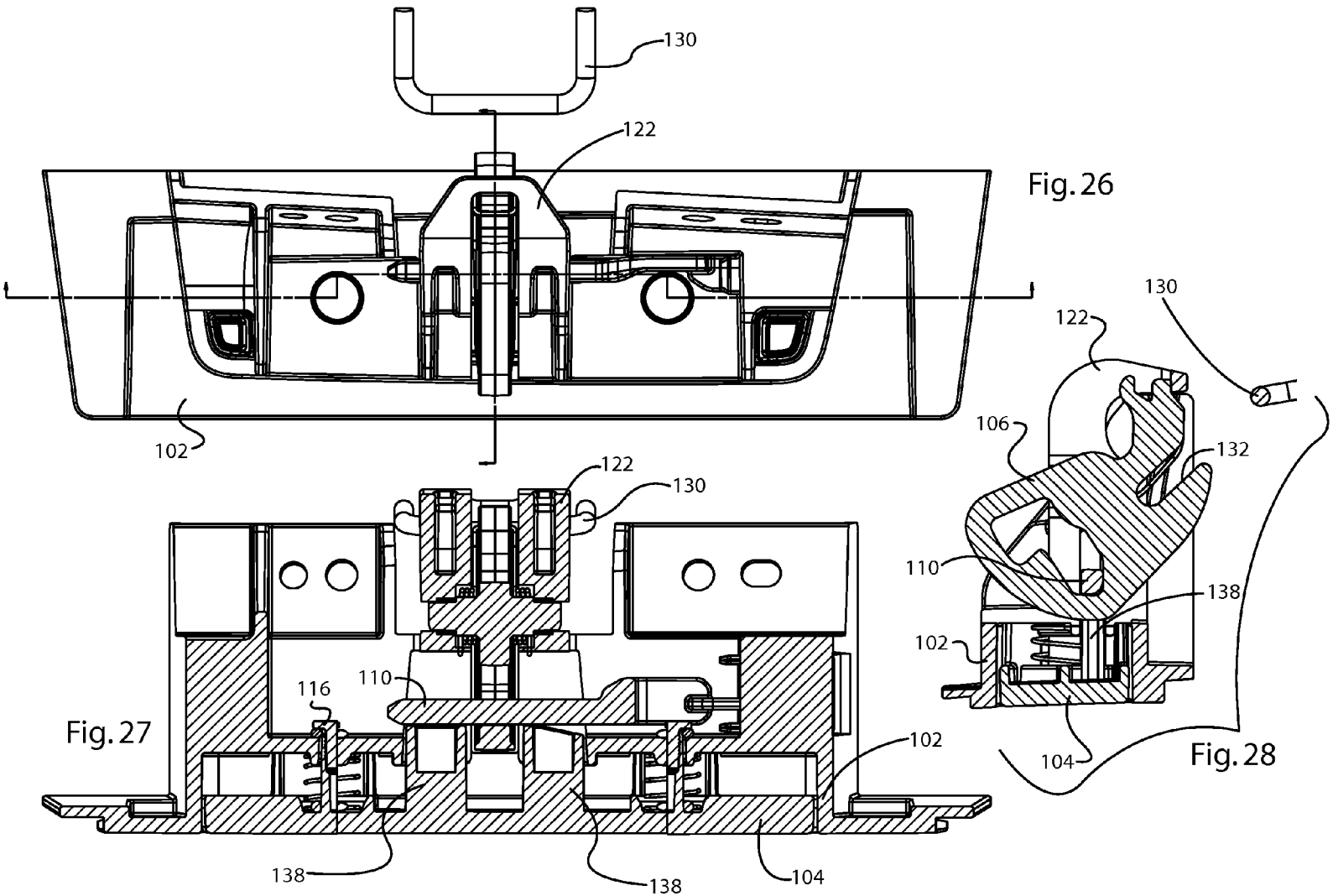
Figure 29:
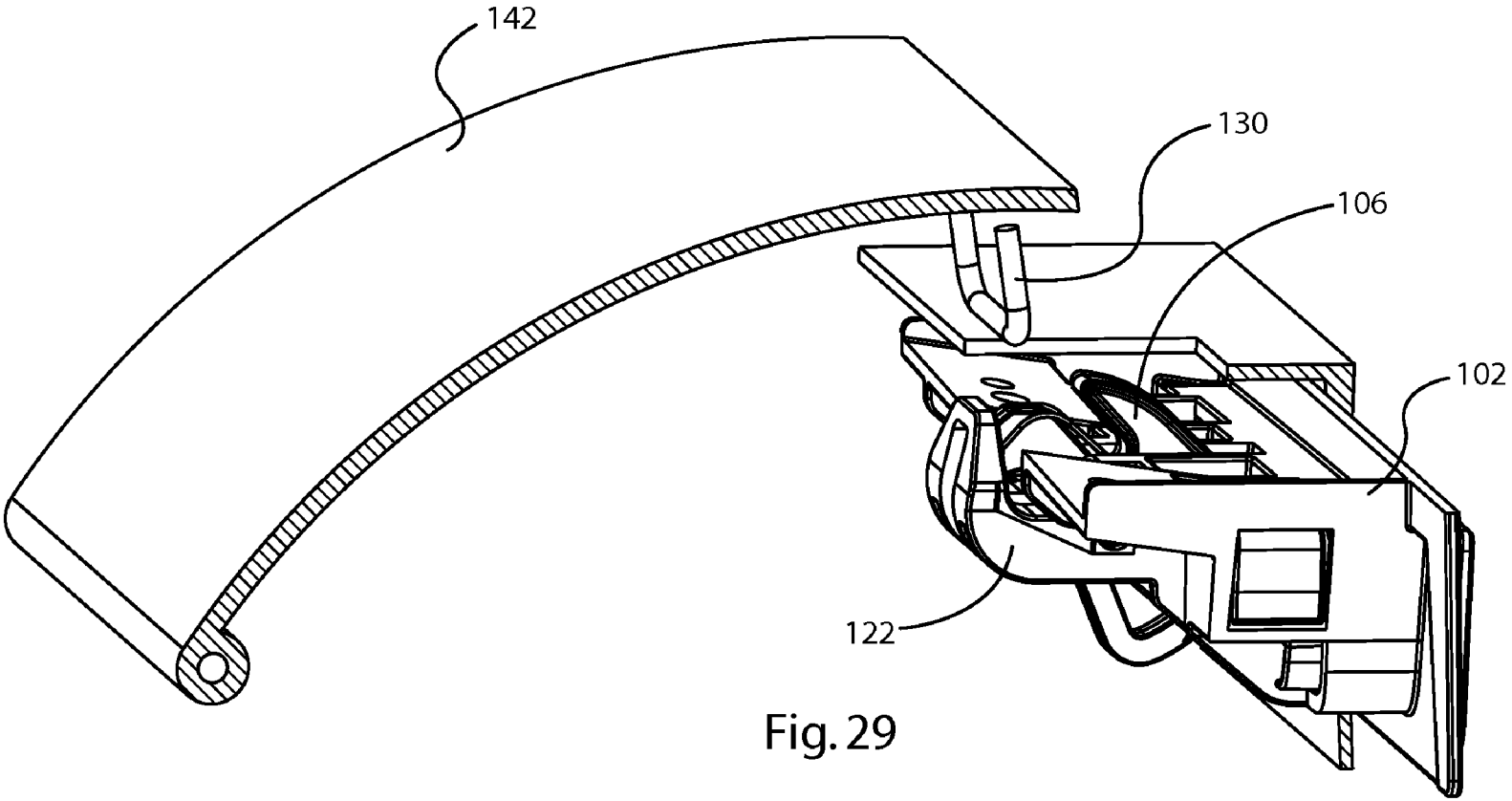
Figures 30, 31, 32, 33, 34, 35:
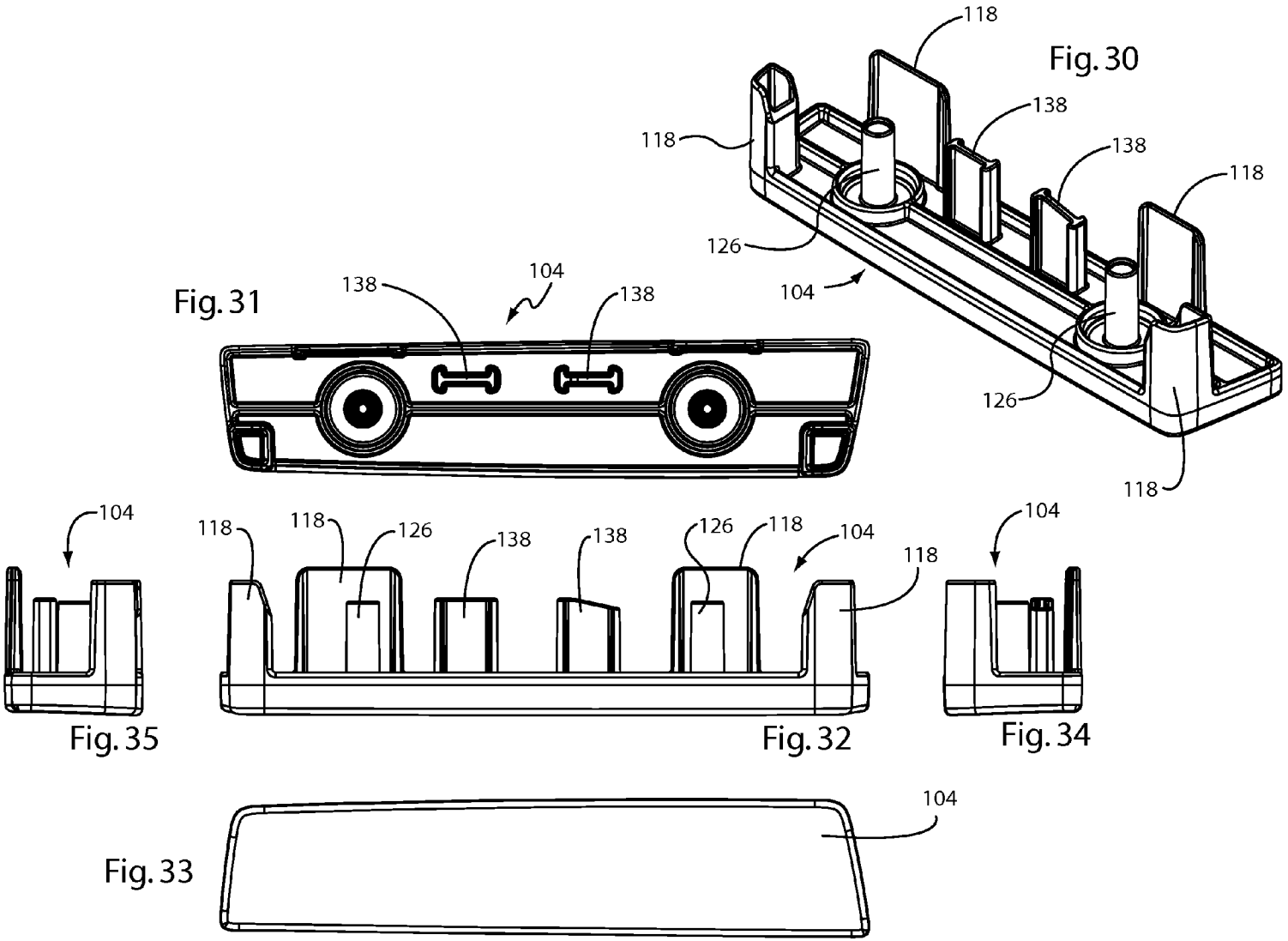
Figures 36, 37, 38:
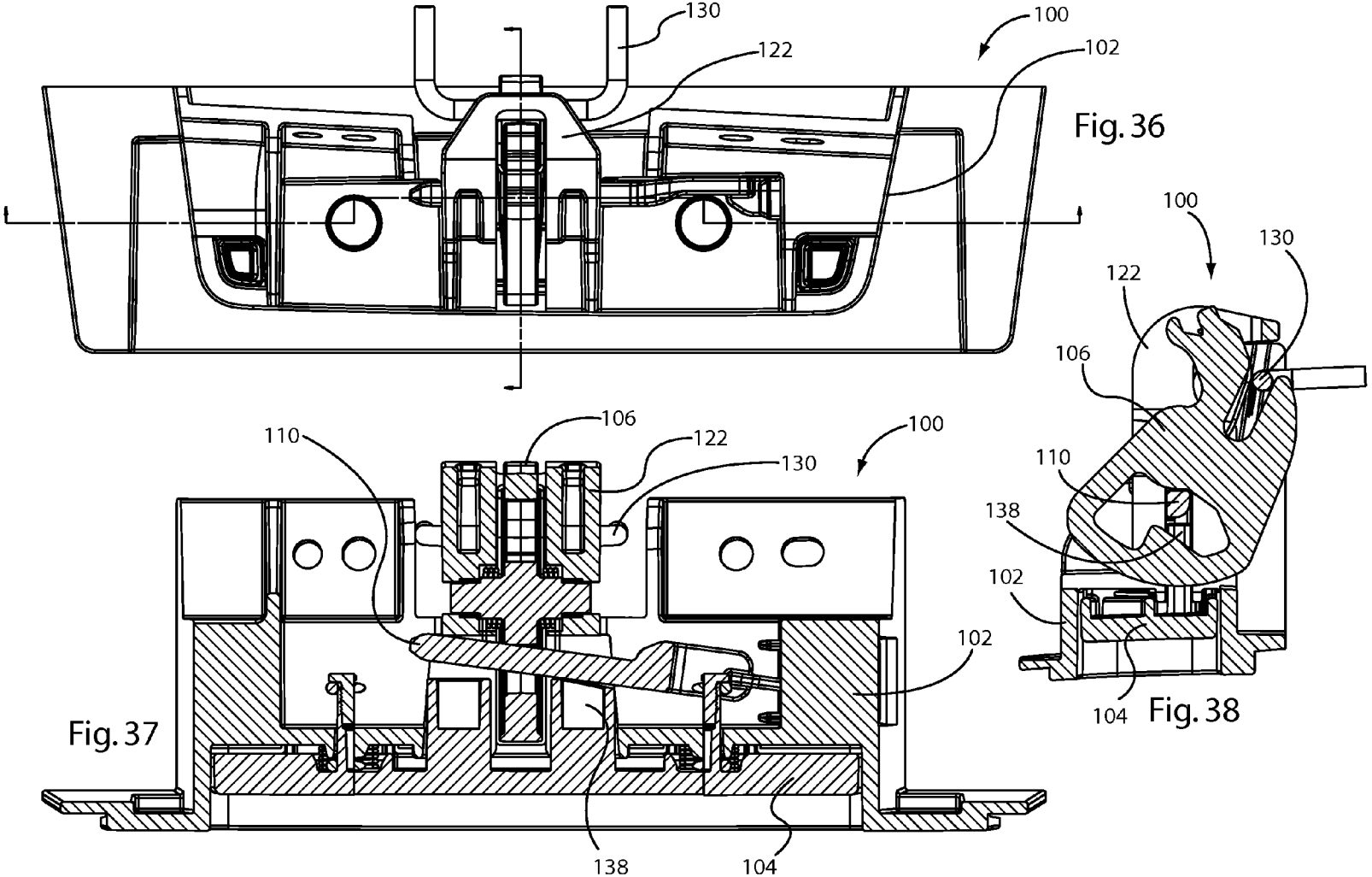
Figure 39:
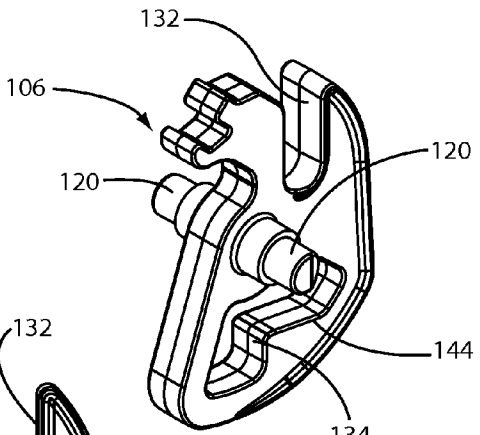
Figure 44:
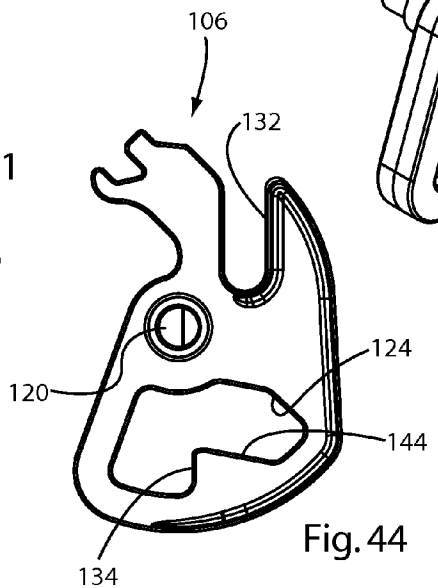
Figure 40:
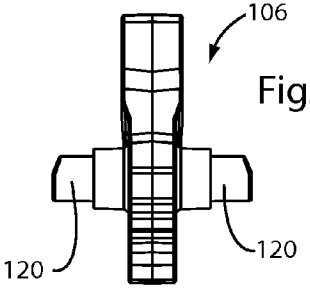
Figure 41:
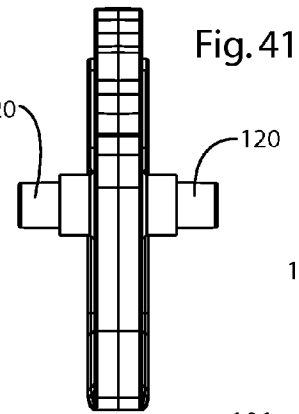
Figure 42:
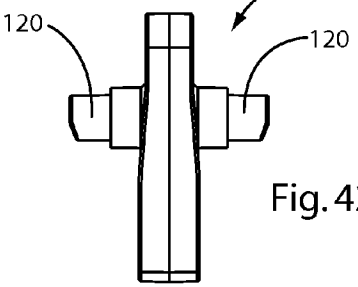
Figure 43:
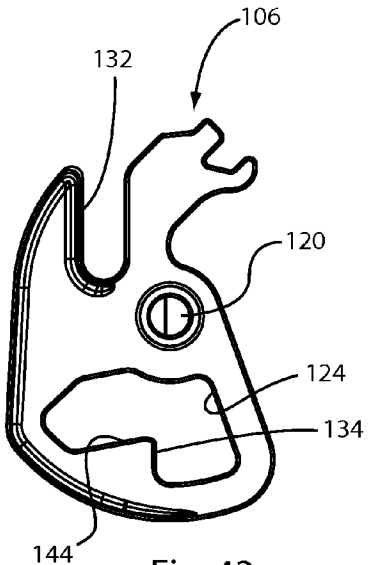
Figures 46, 47, 48, 49, 50:
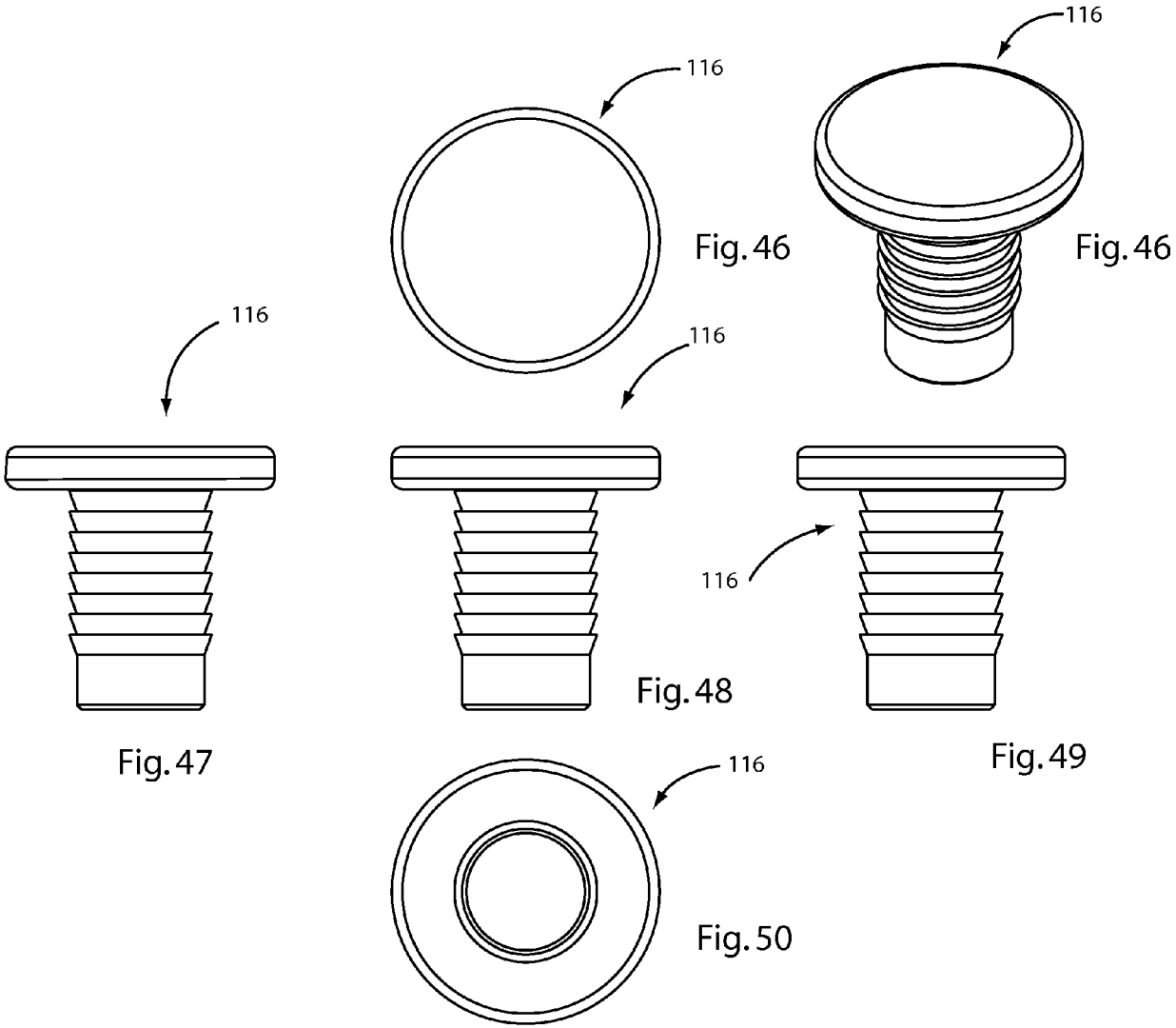
Figure 51:
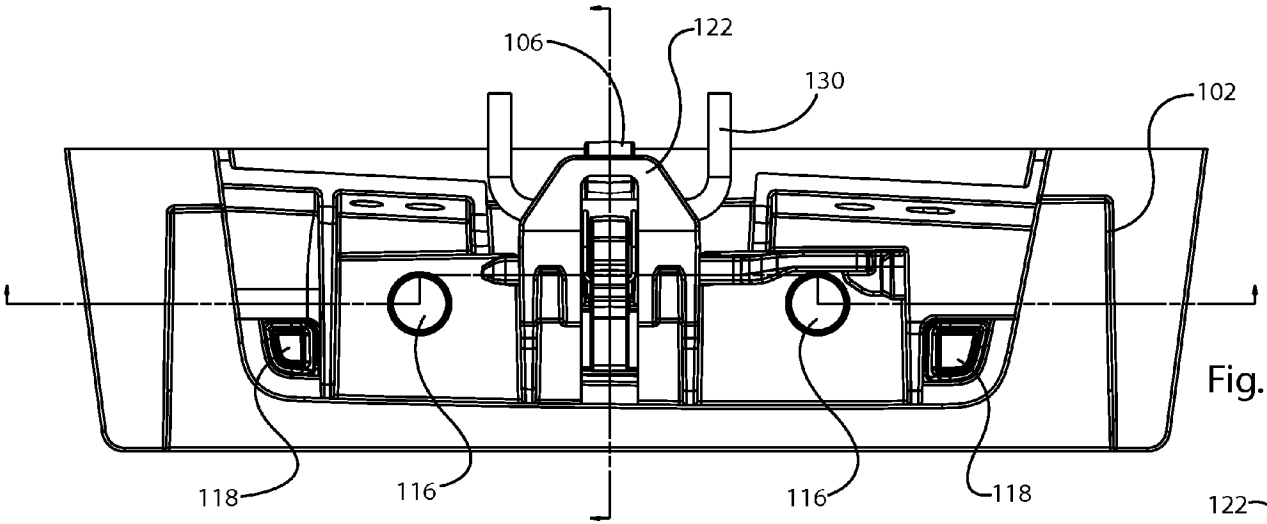
Figure 53:
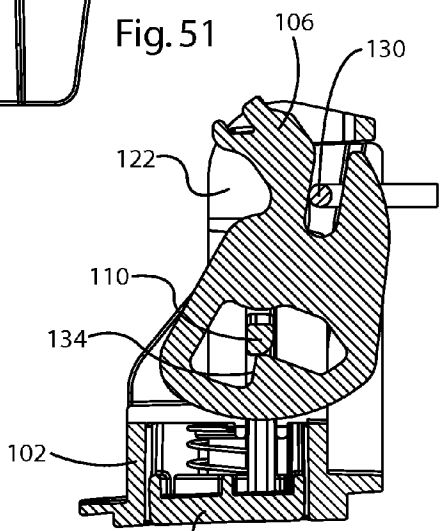
Figure 52:
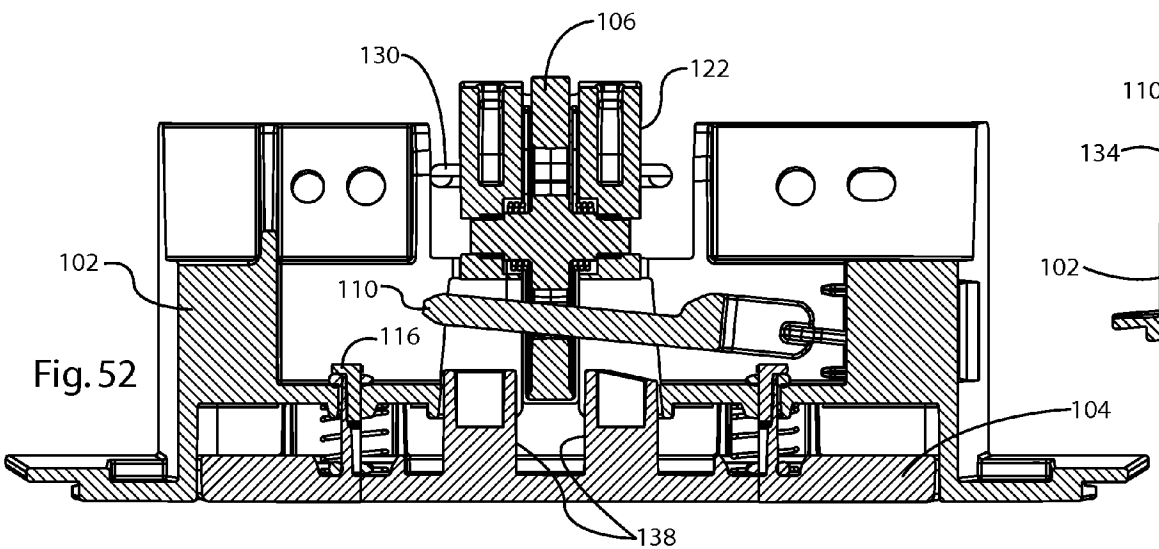
Figure 54:
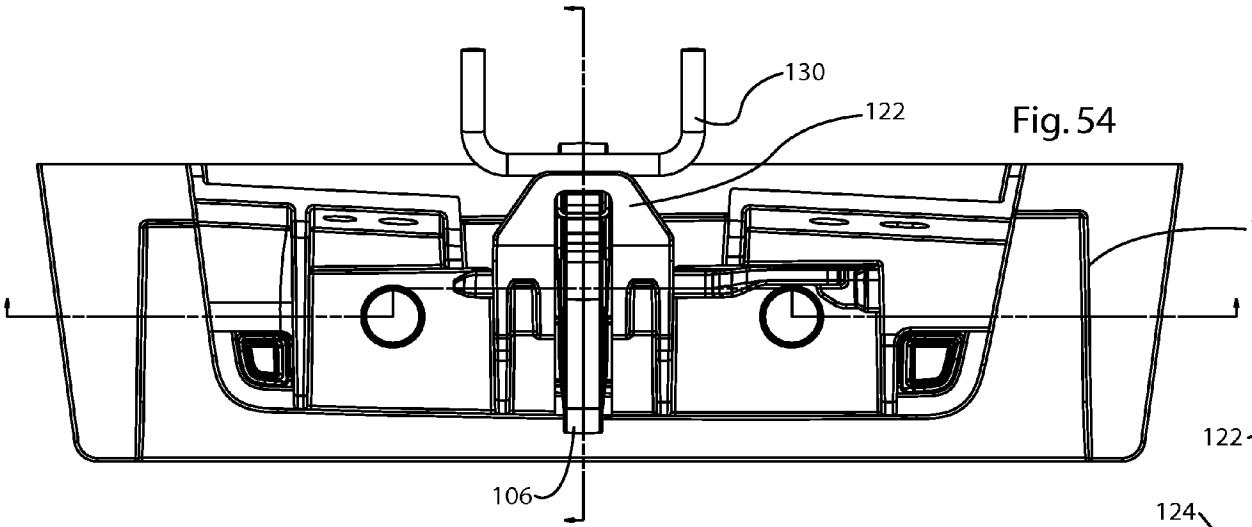
Figure 56:
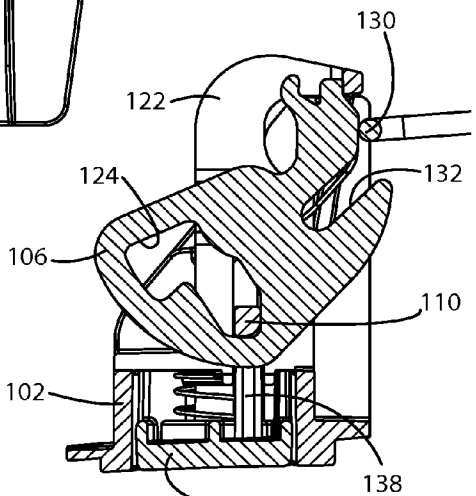
Figure 55:
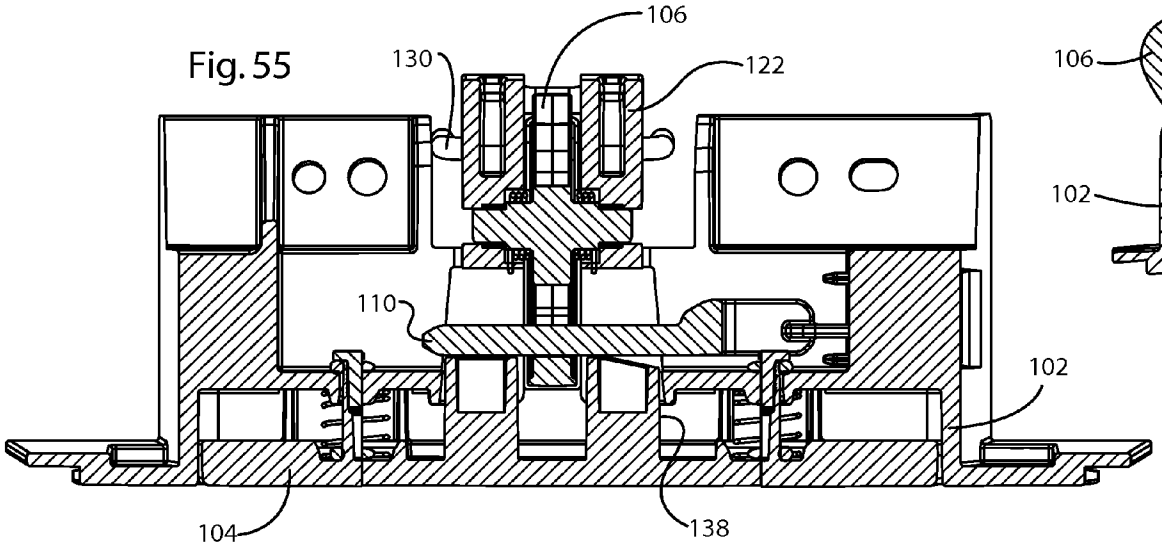
Figures 63, 64, 65, 66, 67, 68, 69:
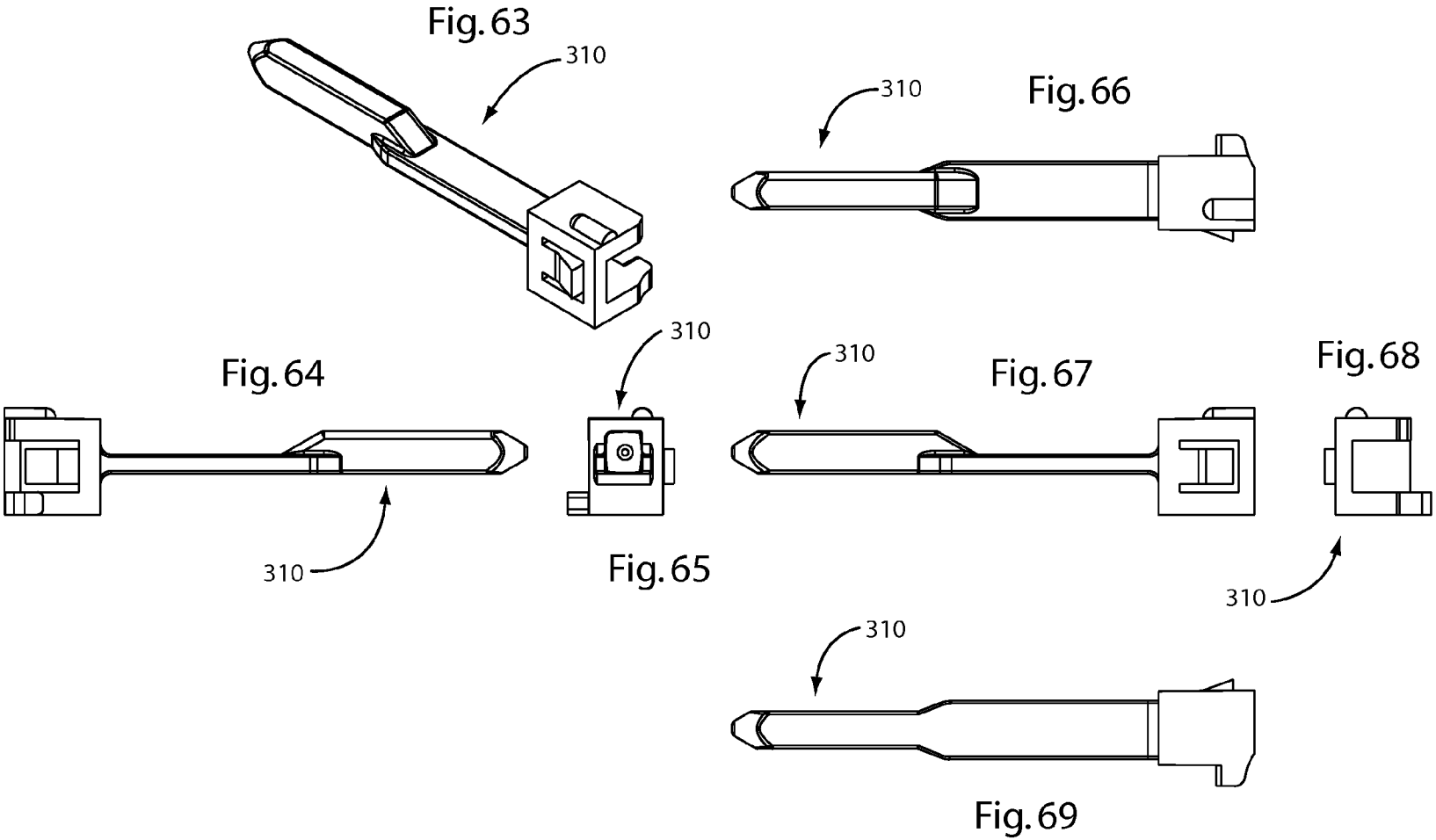
FIGS. 63-128 are views of a second embodiment of a rotary pawl latch according to the present invention.
Figure 72:
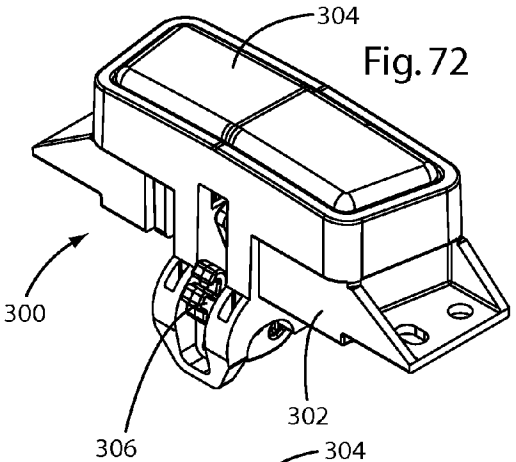
Figure 75:
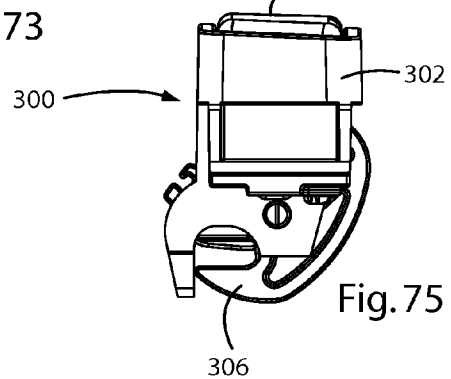
Figure 71:
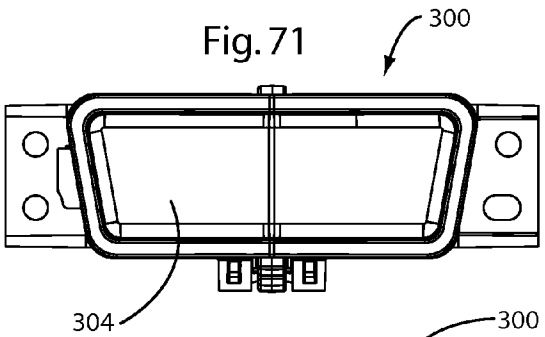
Figure 73:
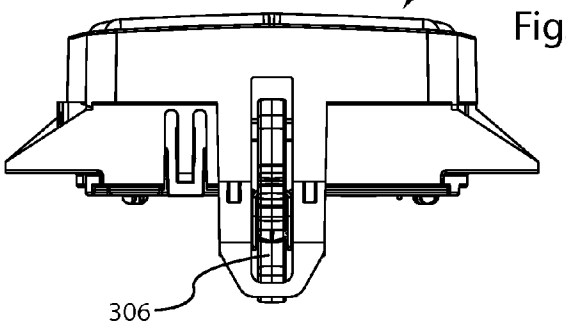
Figure 74:
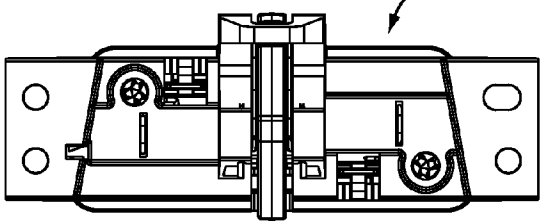
Figure 70:
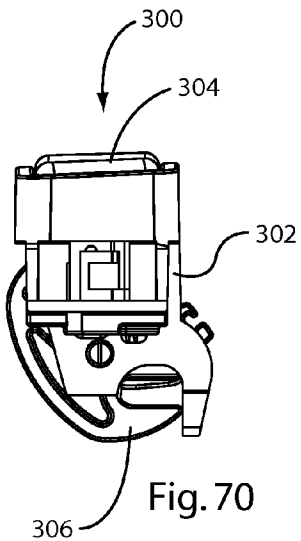
Figure 76:
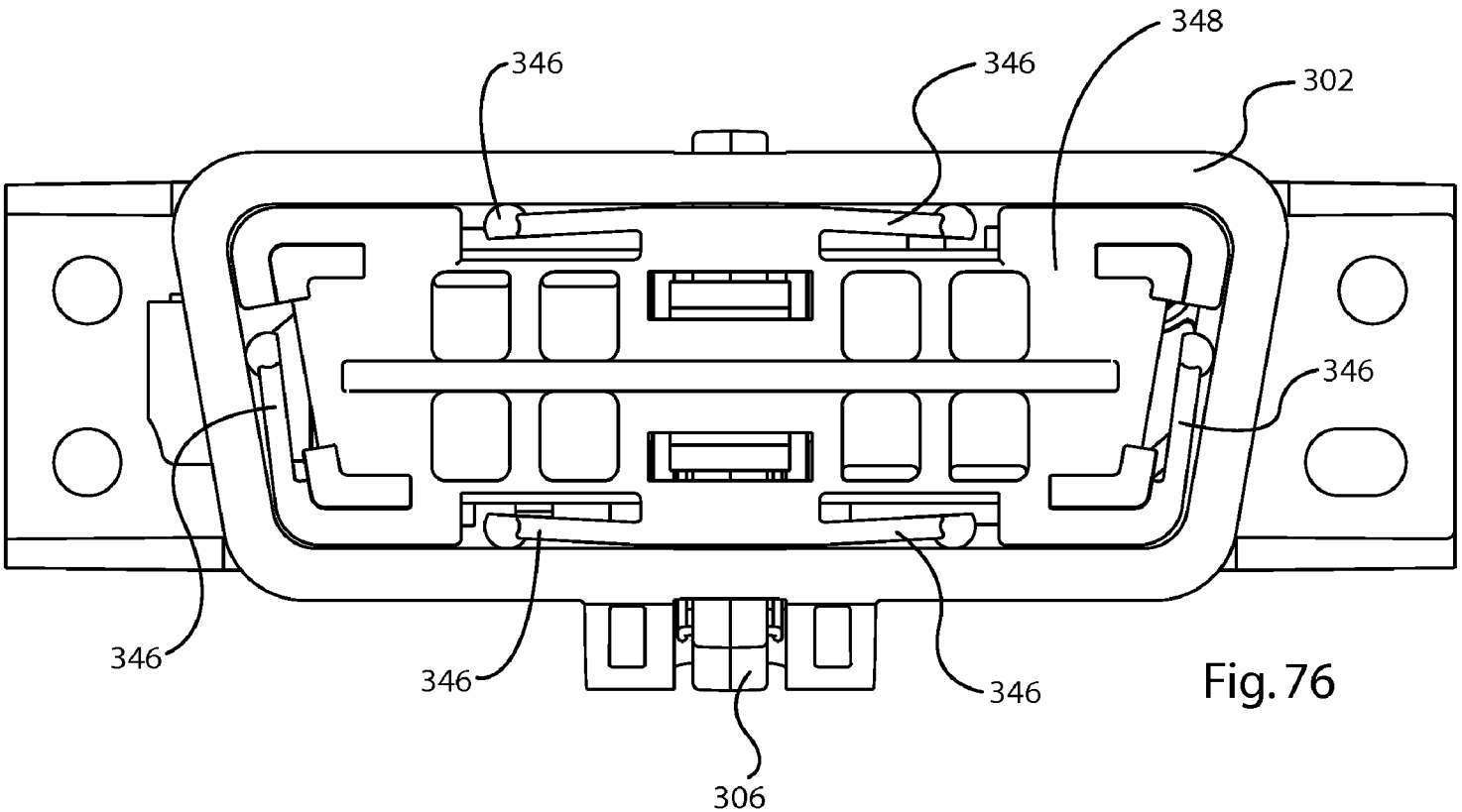
Figure 77:
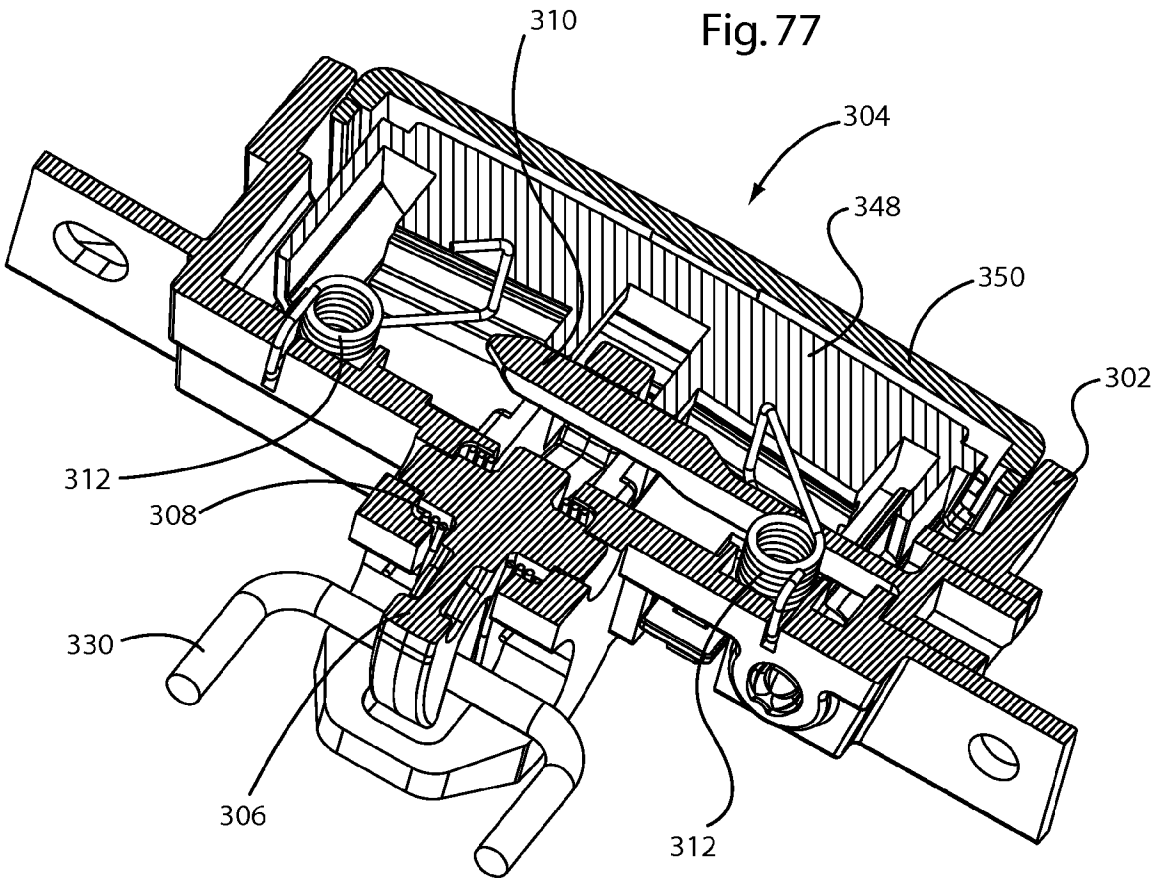
Figure 79:
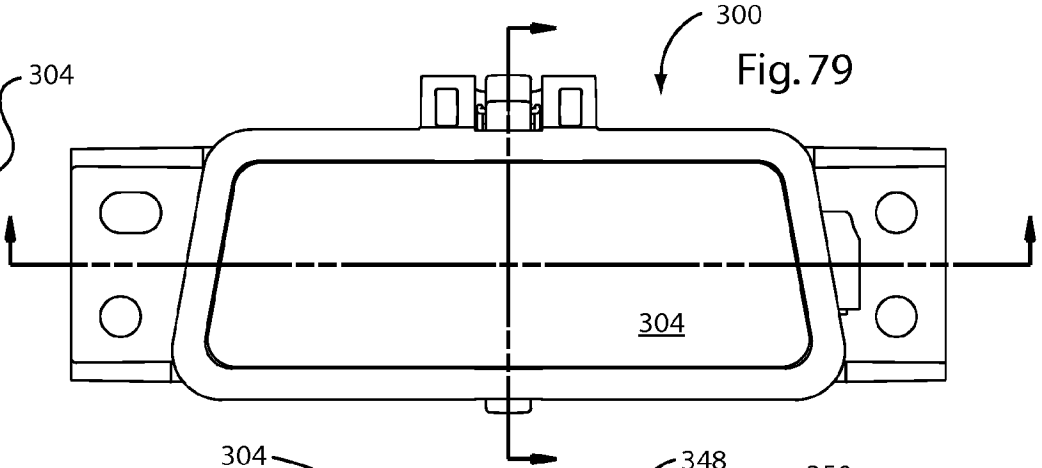
Figure 78:
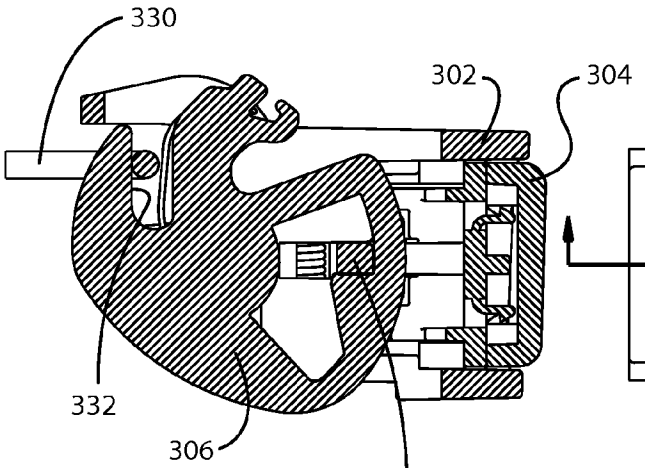
Figure 80:
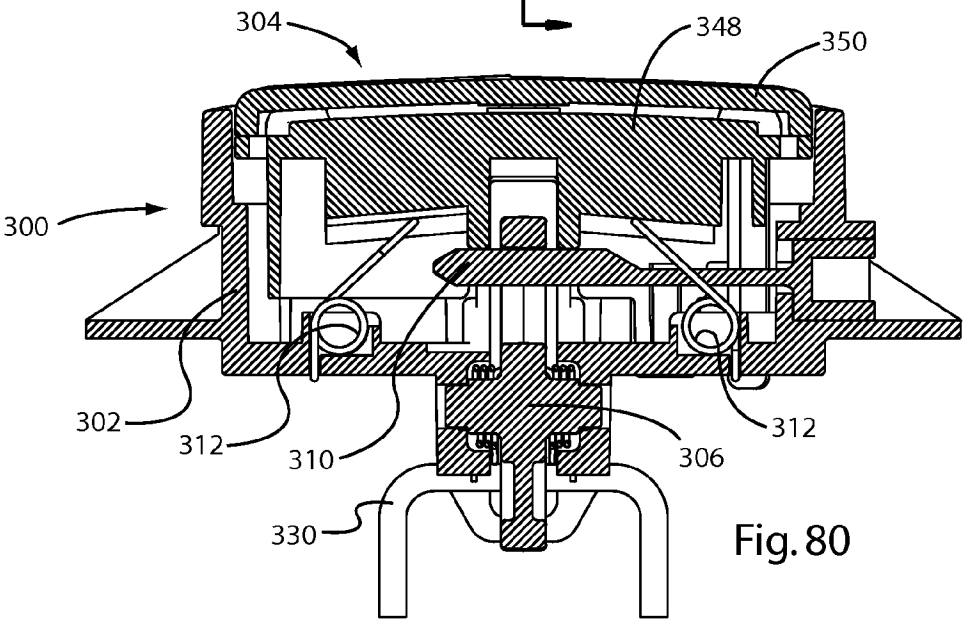
Figure 81:
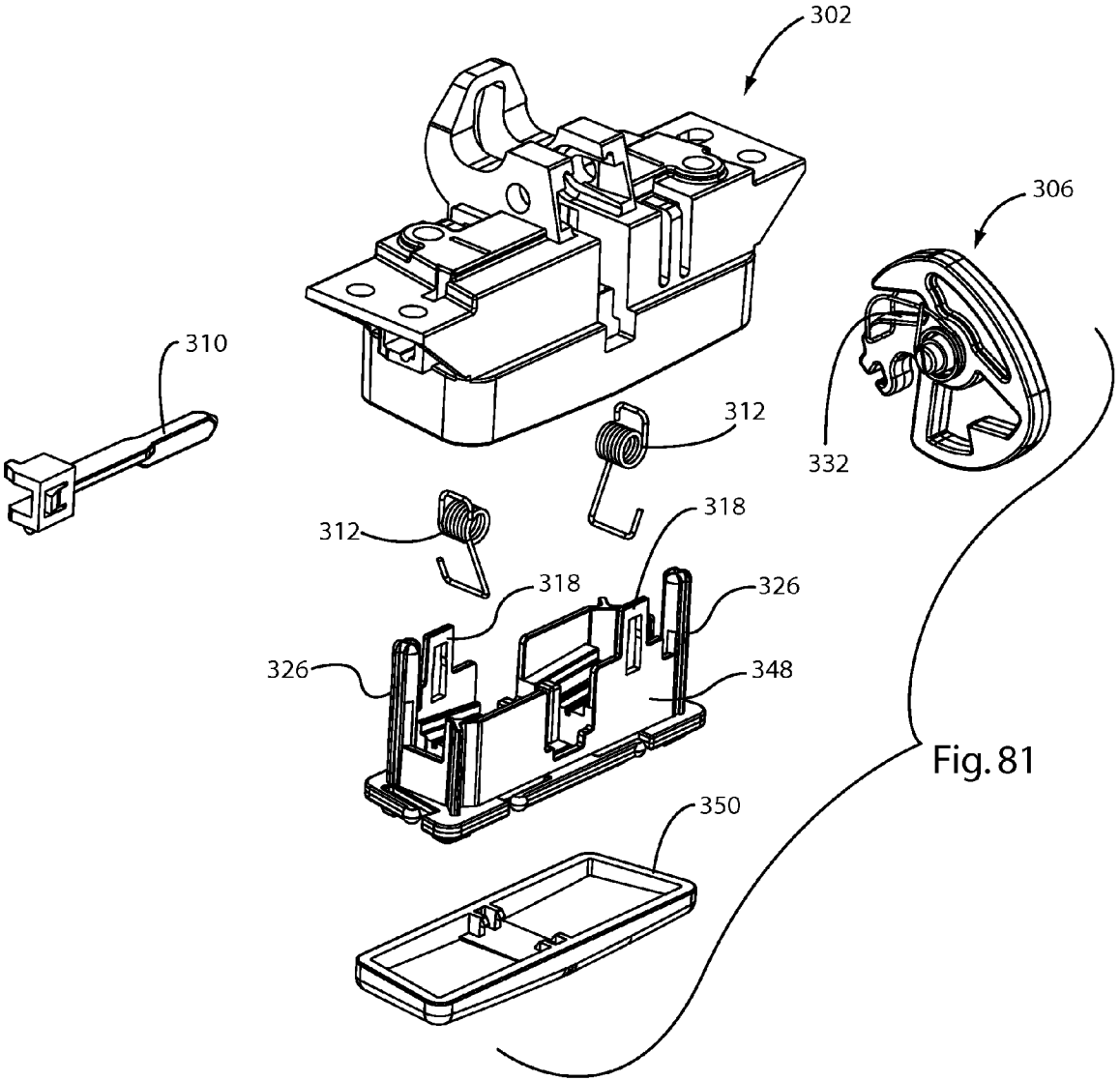
Figure 83:
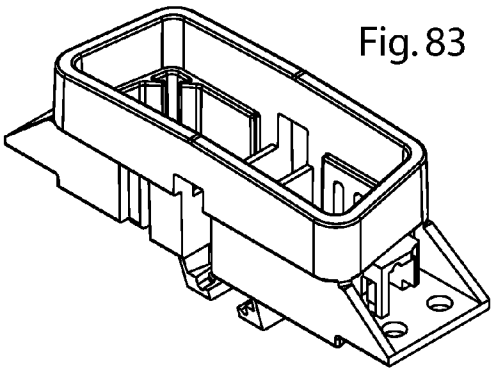
Figure 82:
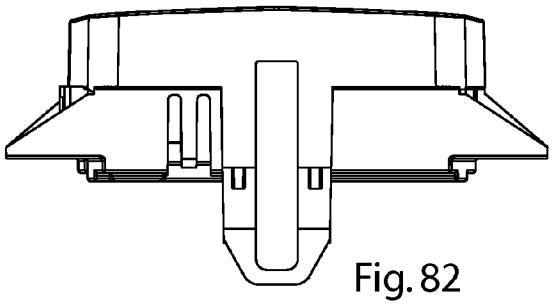
Figure 84:
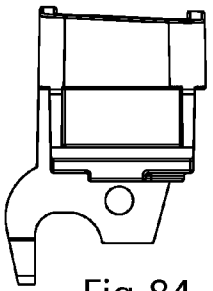
Figure 86:
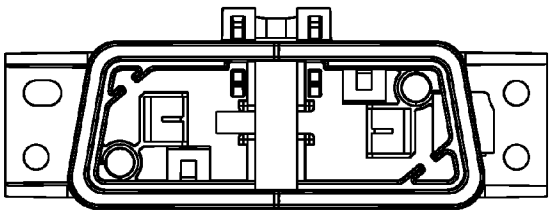
Figure 87:
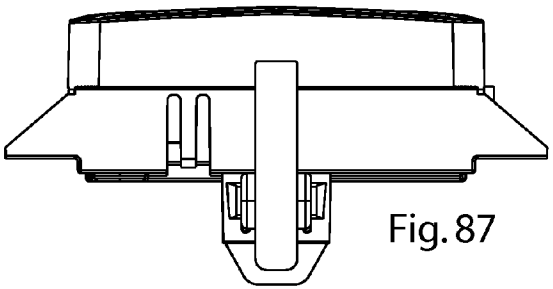
Figure 88:
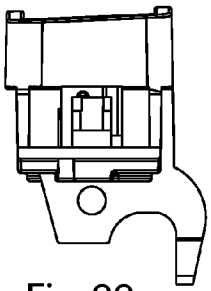
Figure 85:
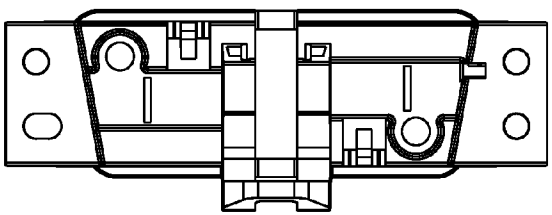
Figure 89:
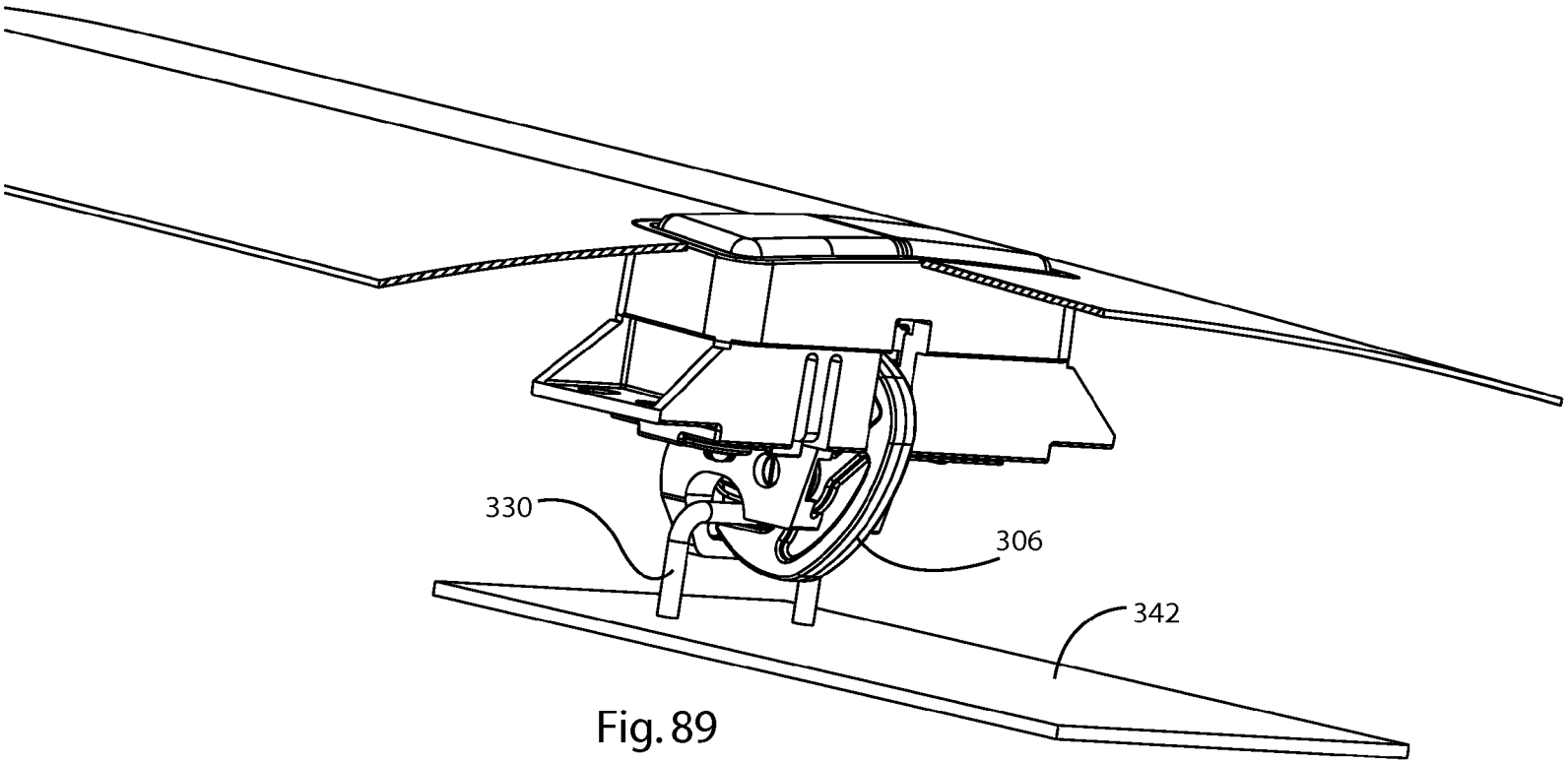
Figure 90:
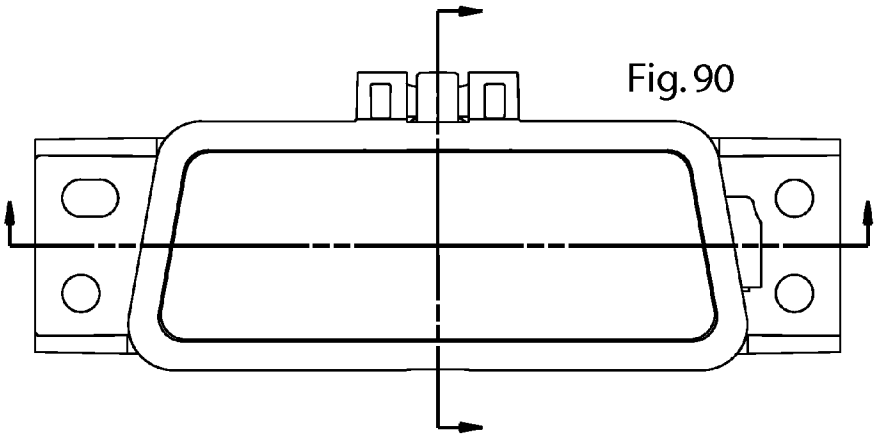
Figure 92:
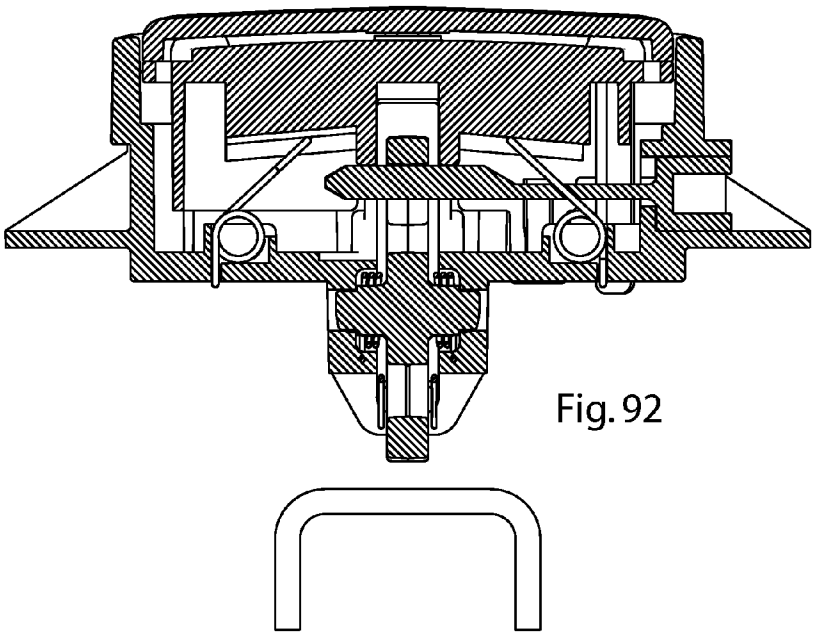
Figure 91:
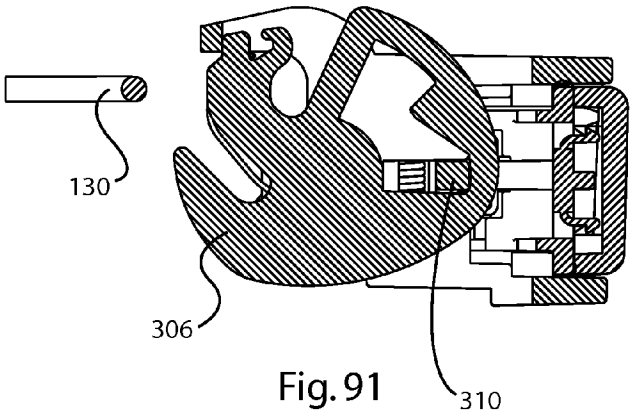
Figure 93:
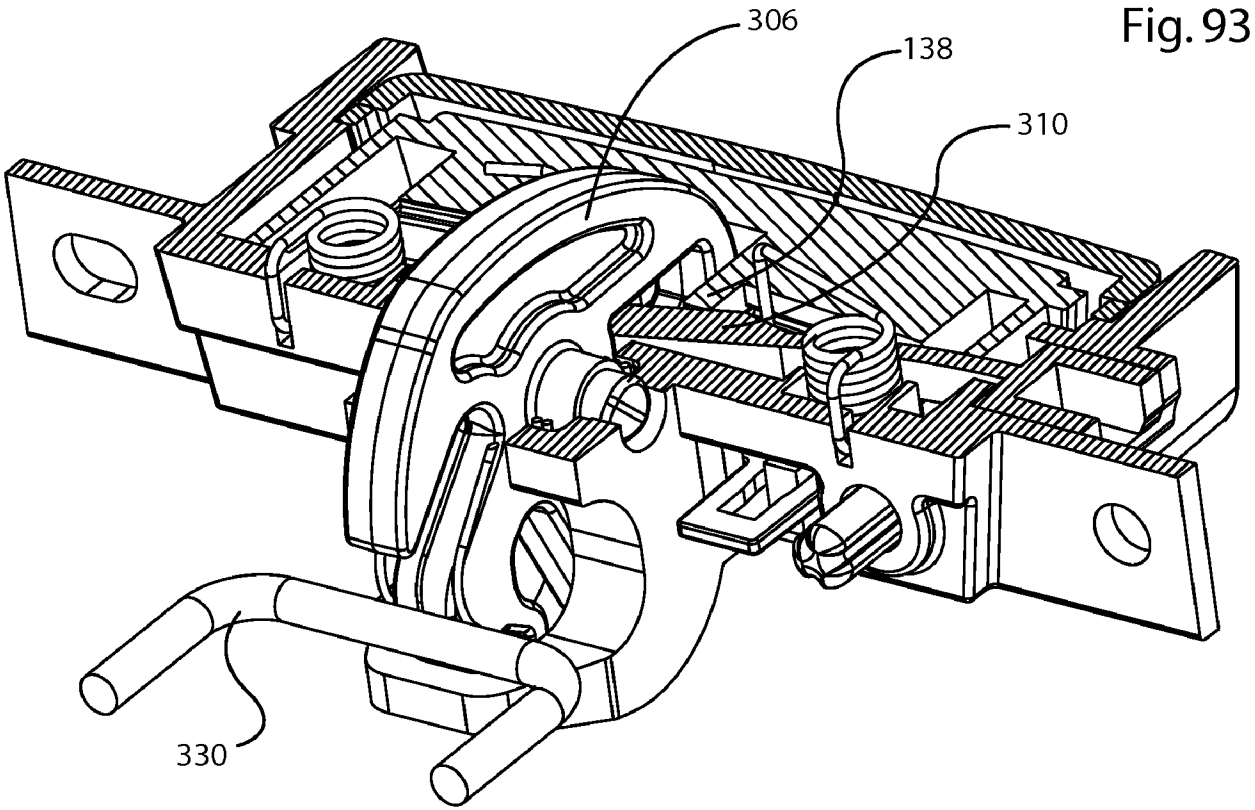
Figure 96:
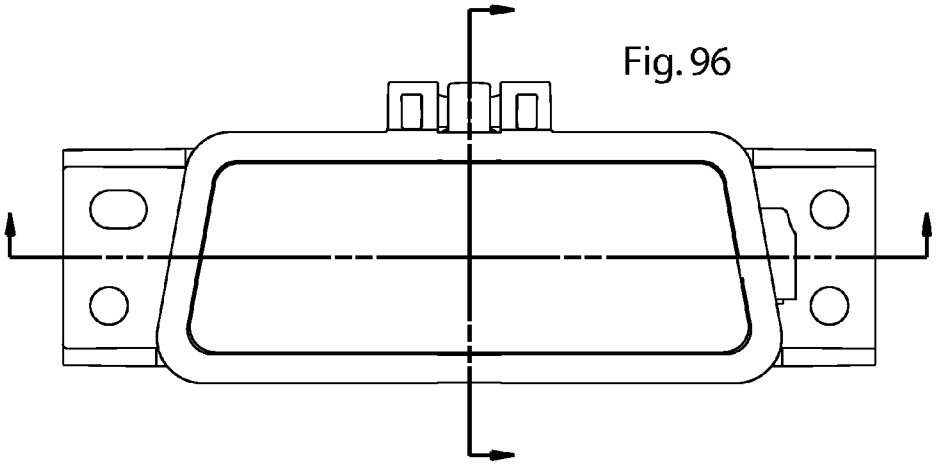
Figure 94:
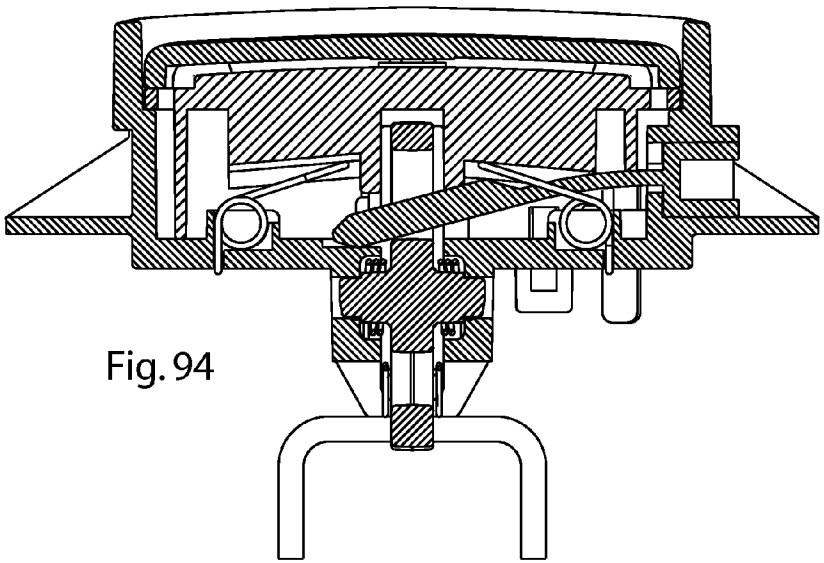
Figure 95:
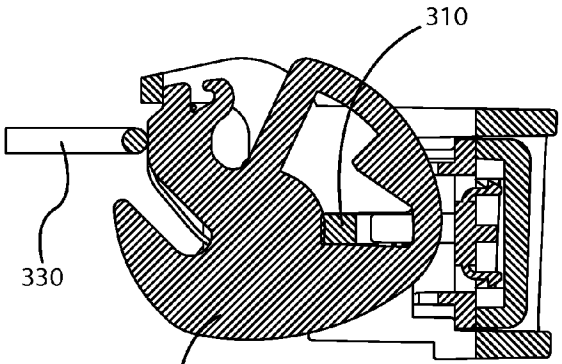
Figure 99:
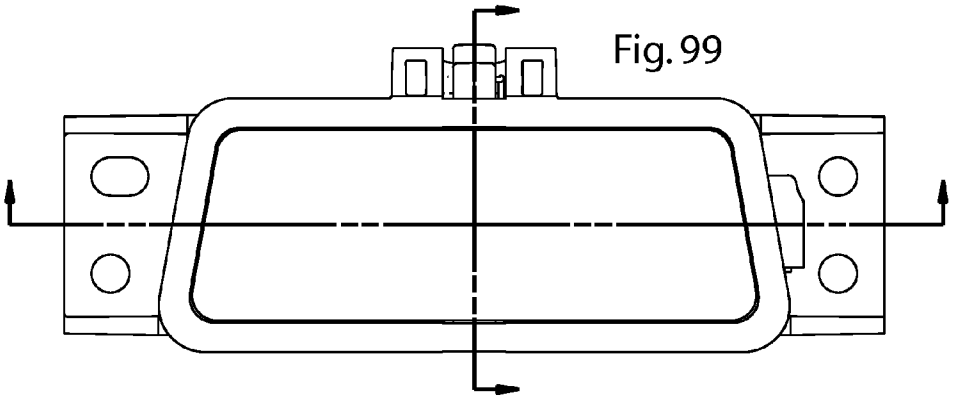
Figure 97:
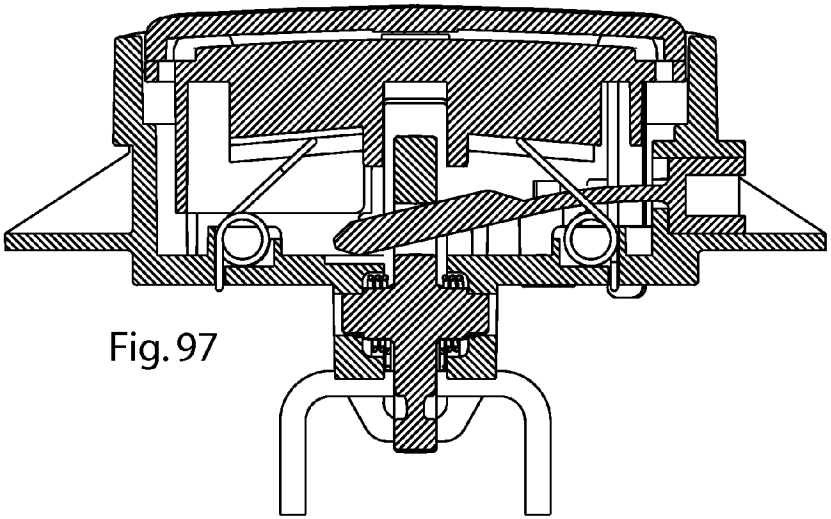
Figure 98:
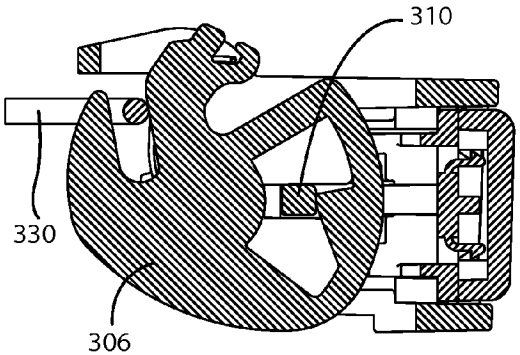
Figure 102:
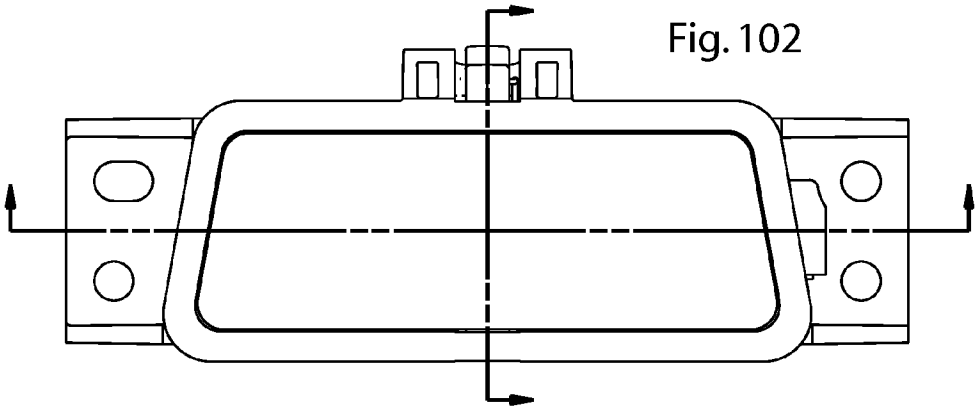
Figure 100:
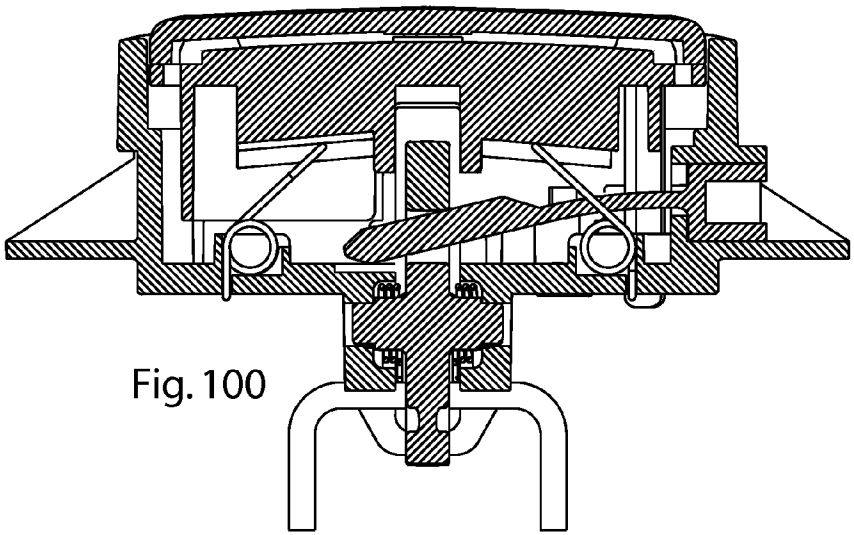
Figure 101:
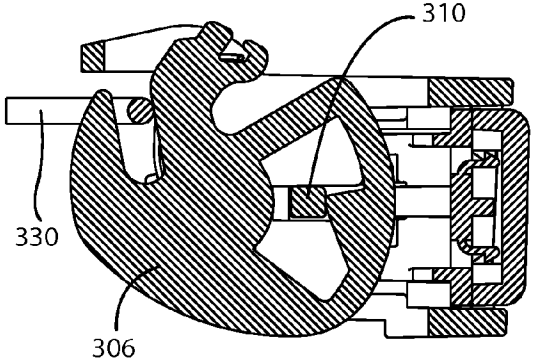
Figure 104:
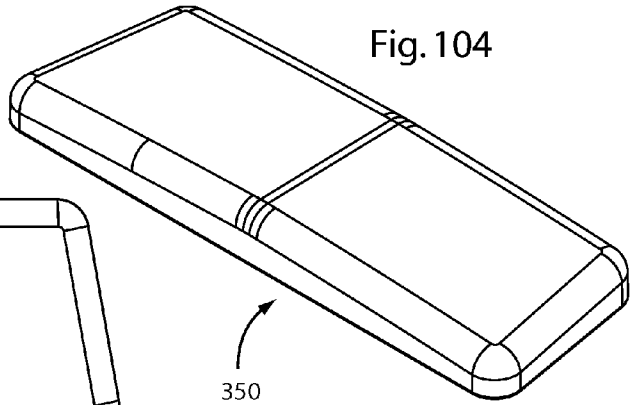
Figure 105:
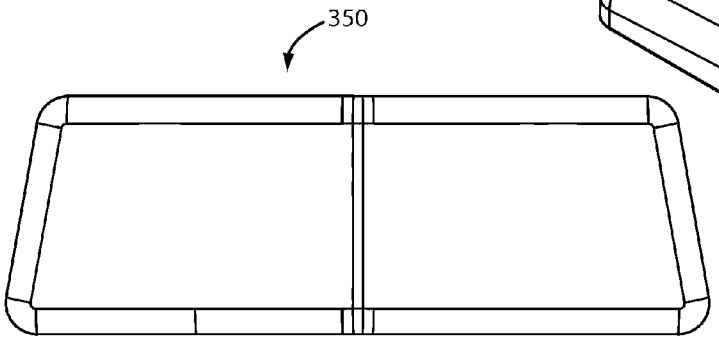
Figure 103:
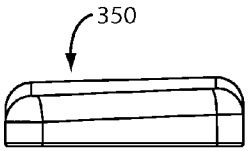
Figure 106:
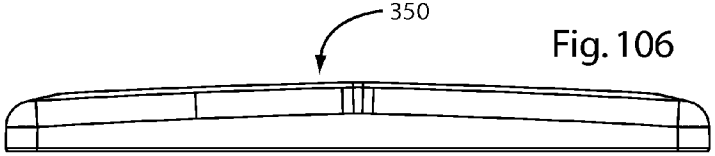
Figure 107:
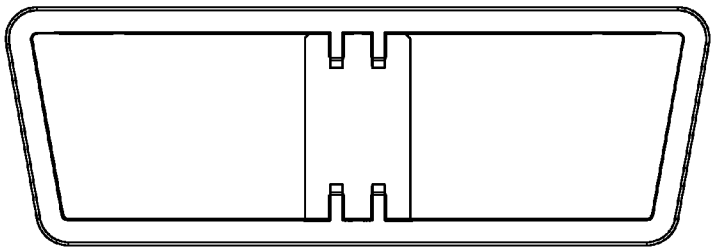
Figure 108:
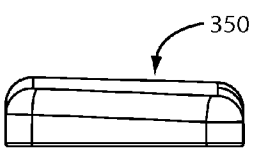
Figure 110:
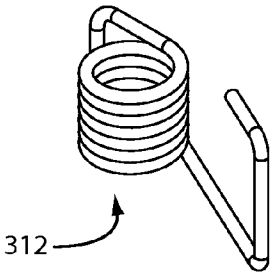
Figure 109:
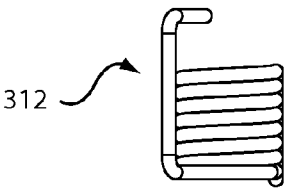
Figure 111:
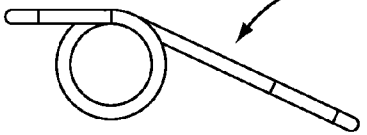
Figure 112:
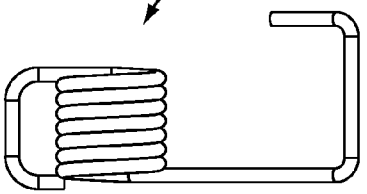
Figure 113:
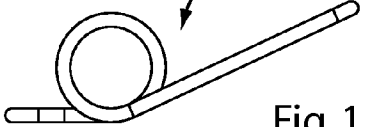
Figure 114:
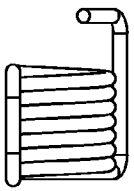
Figure 116:
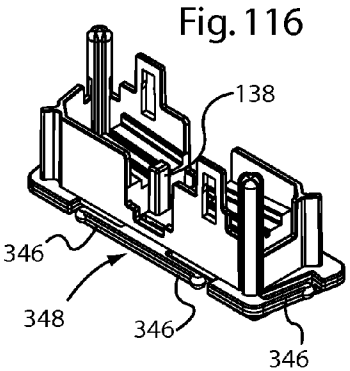
Figure 121:
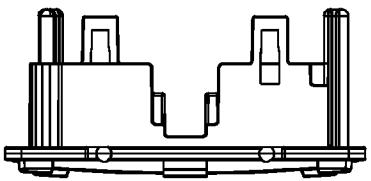
Figure 117:
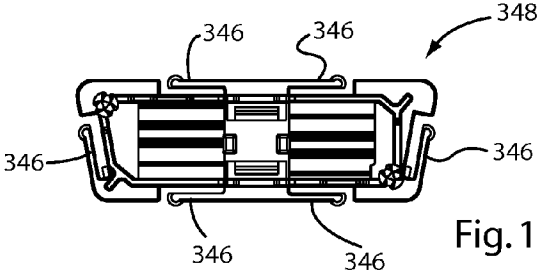
Figure 120:
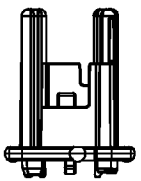
Figure 119:
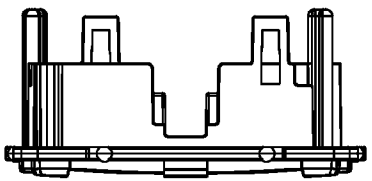
Figure 115:
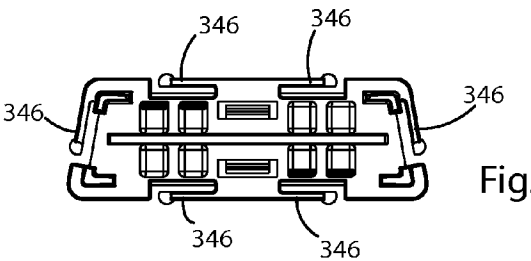
Figure 118:
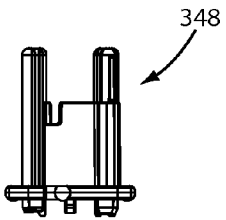
Figure 123:
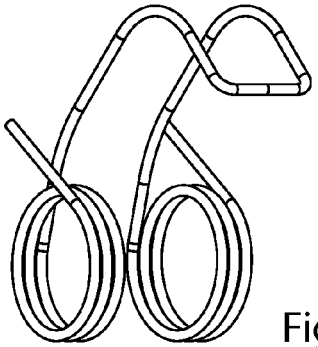
Figure 124:
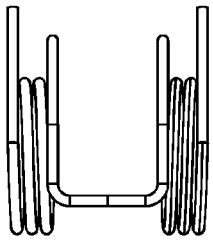
Figure 125:
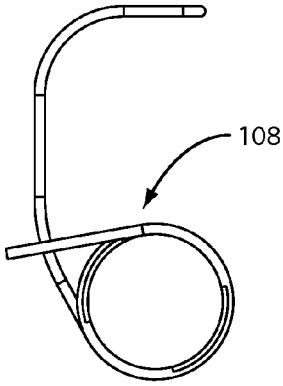
Figure 126:
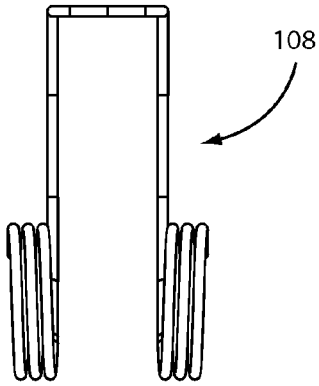
Figure 127:
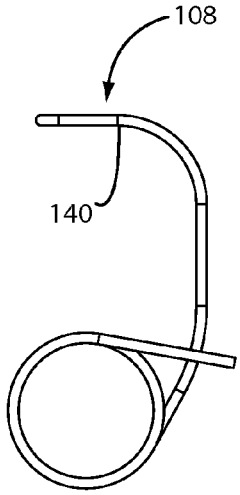
Figure 122:
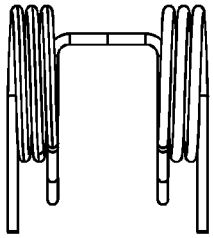
Figure 128:
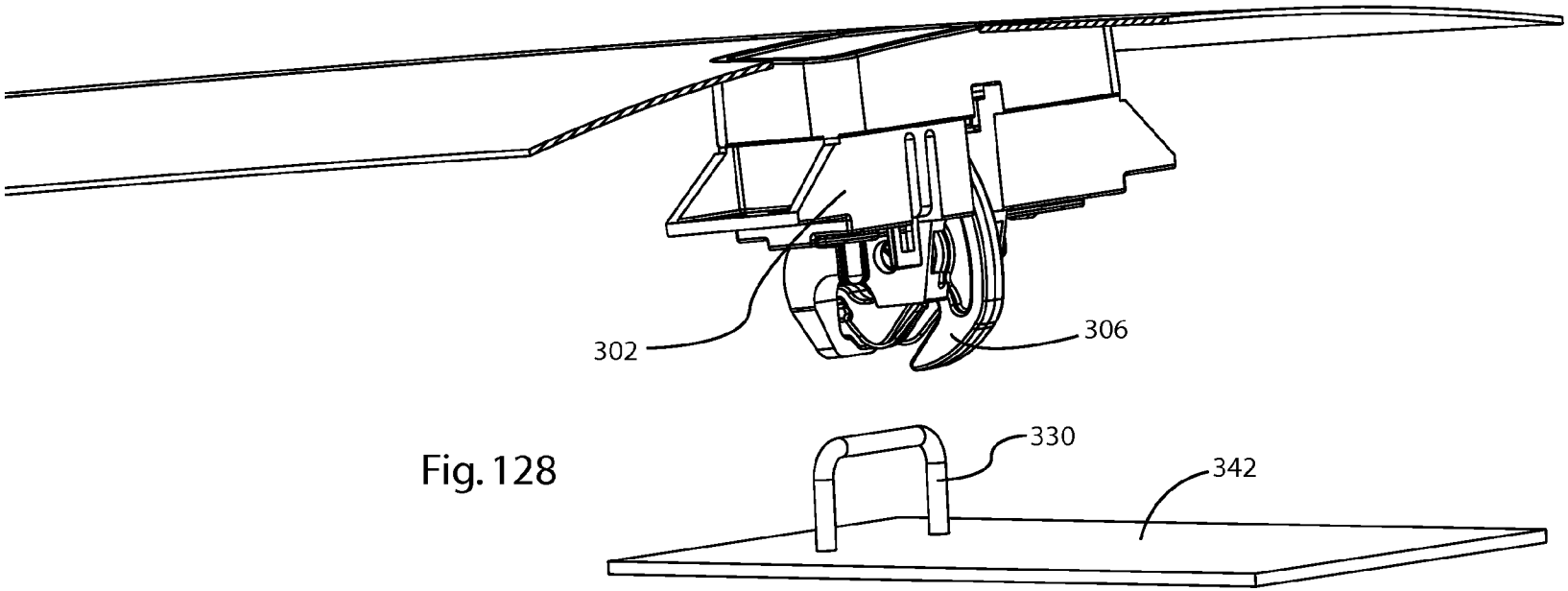

In operation, the button 104 is depressed to the depressed position (e.g. illustrated in FIGS. 38 and 37) into the body of the housing 102. As the button 104 travels rectilinearly inward relative to the housing 102, the integrated guides 118, 126 of the button 104 act to stabilize the movement of the button and the two center ribs 138 begin to act on the lock bar 110. Continuing to press the button 104 causes the center ribs 138 to flex the lock bar 110 (the lock bar 110 is a living spring design with its natural unloaded state in the "latched" position illustrated e.g. in FIGS. 9 and 10) towards the center, i.e. axis of rotation, of the pawl 106. As the lock bar 110 moves toward the center of the pawl 106, the torsion spring load on the pawl 106 acts to try and move the pawl 106 to the unlatched position illustrated e.g. in FIG. 28. Once the button 104 is moved far enough inward of the housing 102, the lock bar 110 moves out of engagement with the step 134 in the pawl 106, as shown in FIG. 38, and the pawl 106 can begin to rotate to the unlatched position under the bias of torsion spring 108. This allows the striker 130 to be released and the door 142 to be opened as shown in FIGS. 28 and 29. Continuing to depress the button 104 will cause the internal O-rings 136 to impact against the other side of the housing 102 in relation to O-rings 114. This helps reduce the noise of operation. As long at the button 104 is fully depressed, the pawl 106 does not fully open but is set to move and remain in the unlatched position upon release of the button 104. When the button 104 is released, the pawl 106 can finish rotating to the unlatched position and the button 104 returns to its outward-most position dead-stopping the O-rings 114 against the housing 102 to again reduce operational noise. With the pawl 106 in the unlatched position and the button 104 released, the lock bar 110 is allowed to relax and return to its natural unloaded state, illustrated in FIGS. 9, 10, 27, and 28, by virtue of the shape of the inner cam profile 144 of the lock bar slot 124 of the pawl 106.

Figure 11:
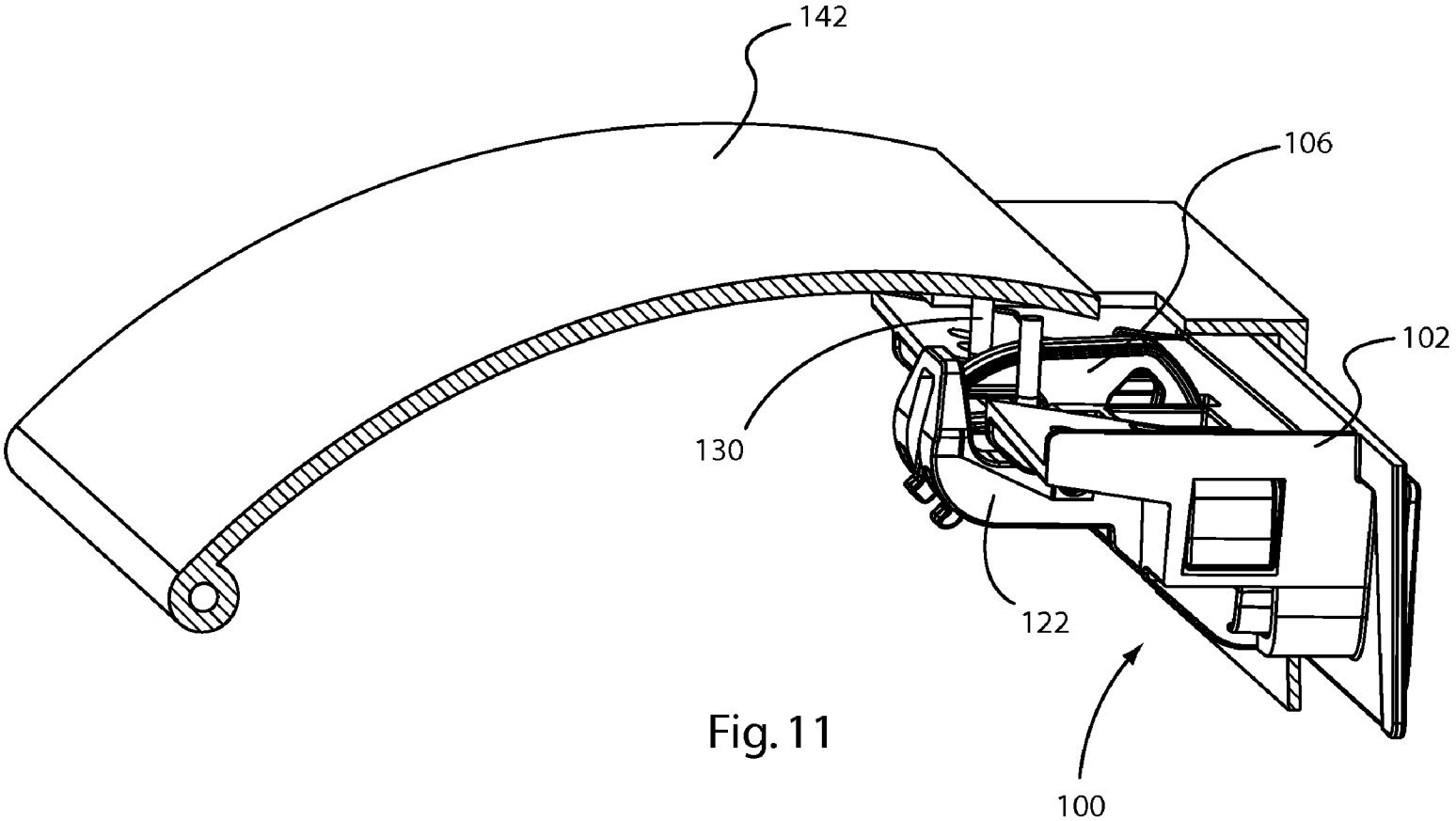
Figure 12:
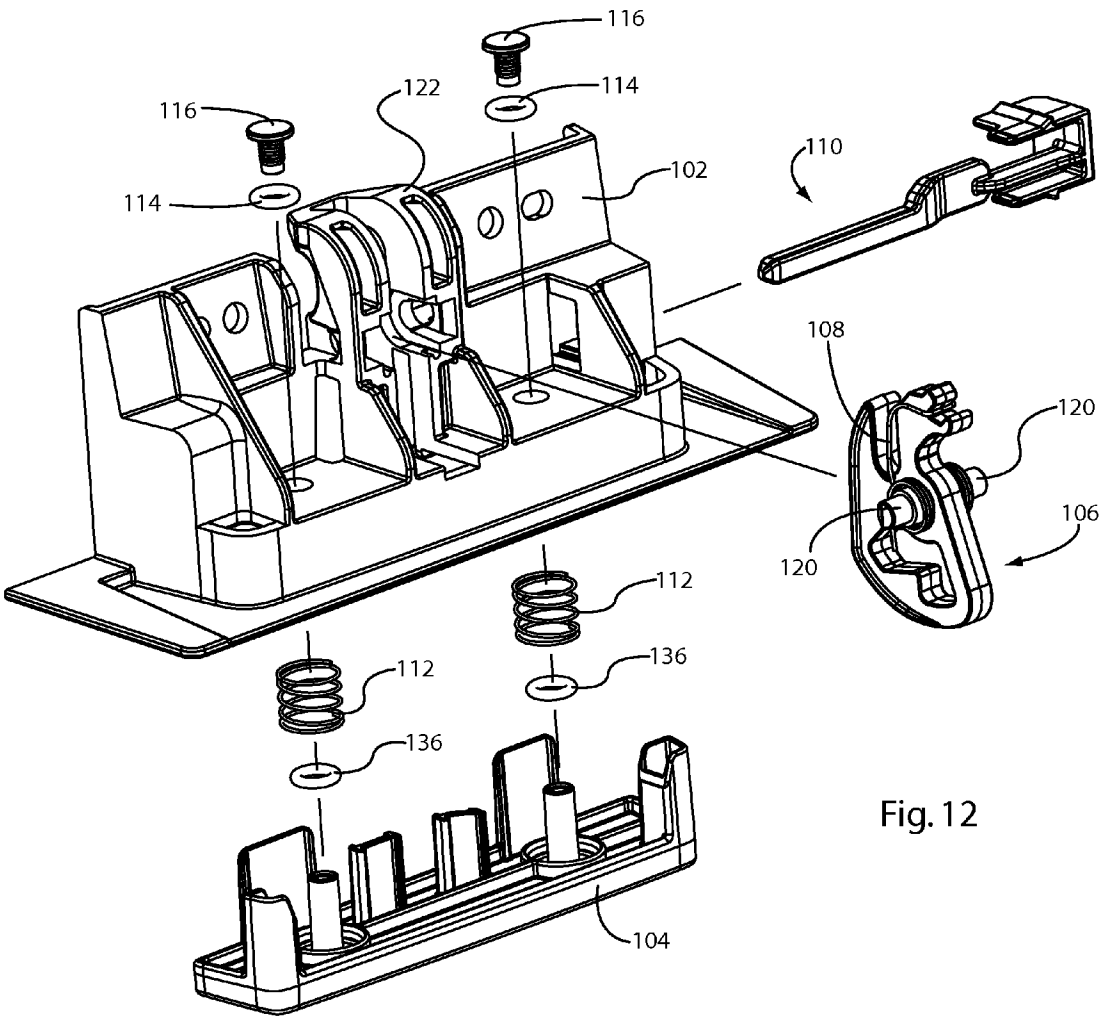
Figure 13:
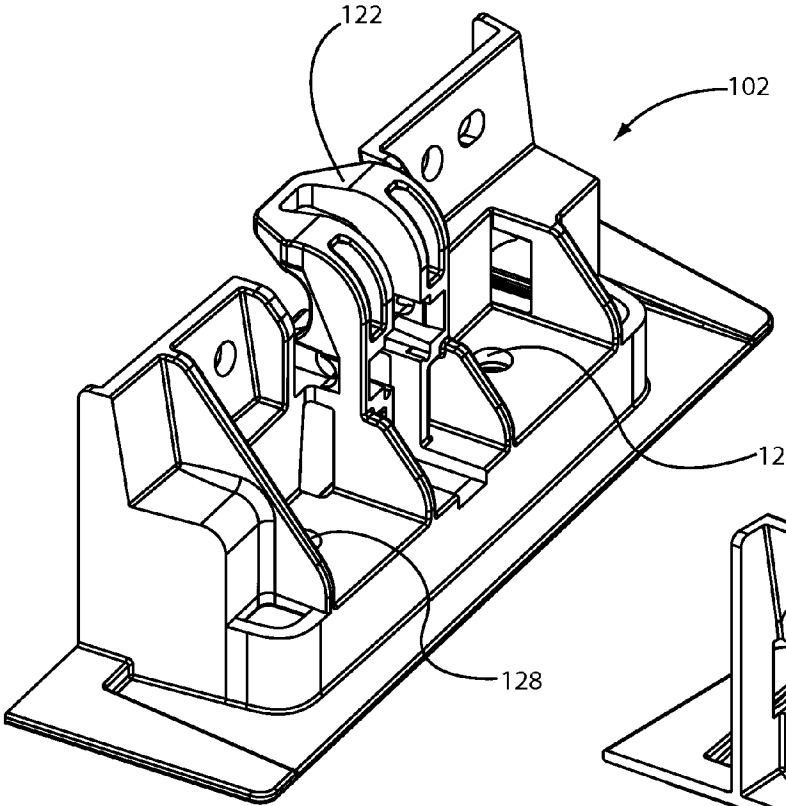
Figure 14:
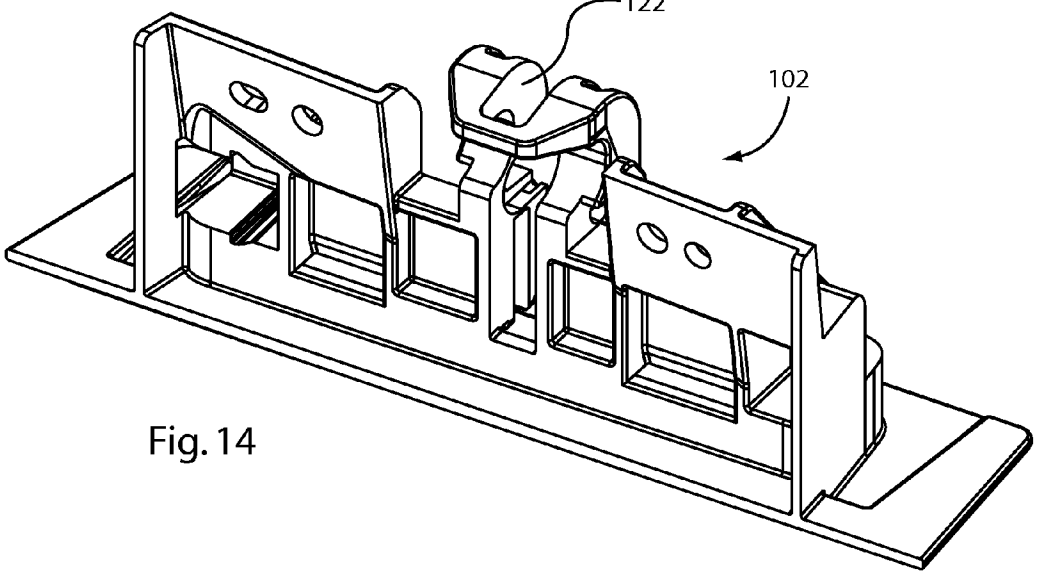
Figure 15:
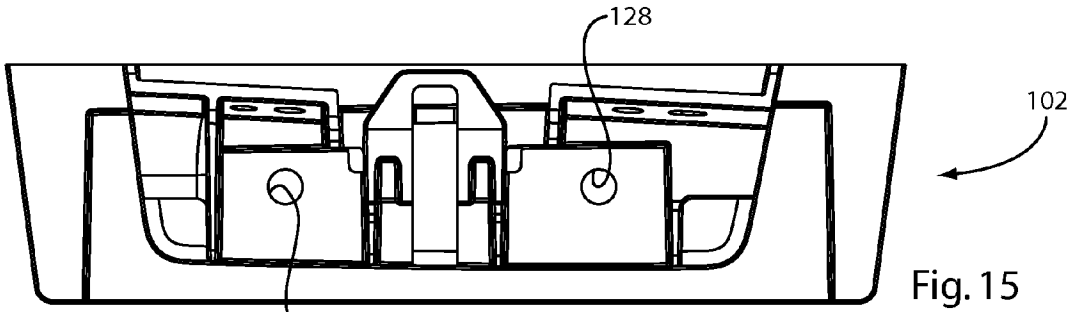
Figure 16:
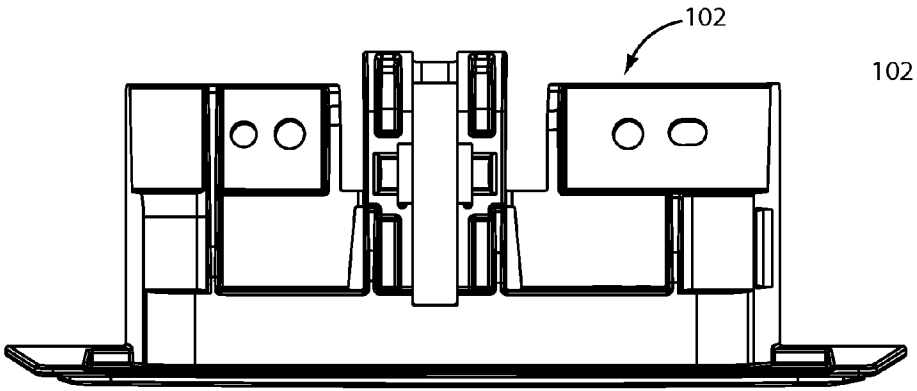
Figure 18:
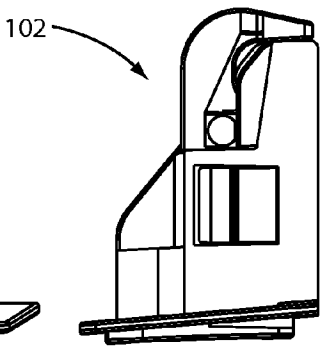
Figure 17:
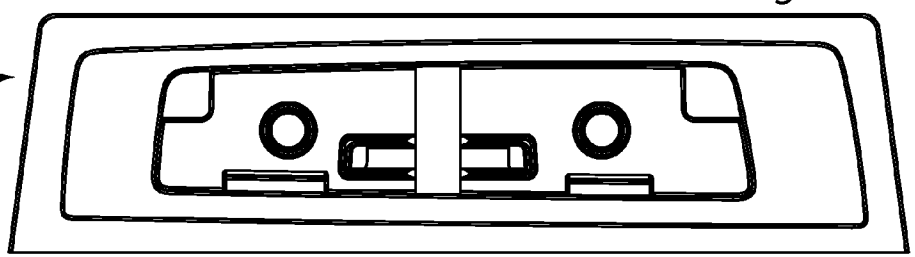
Figure 19:
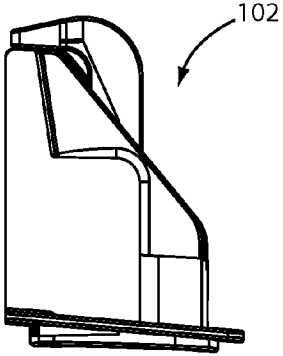
Figures 20, 21, 22, 23, 24, 25:
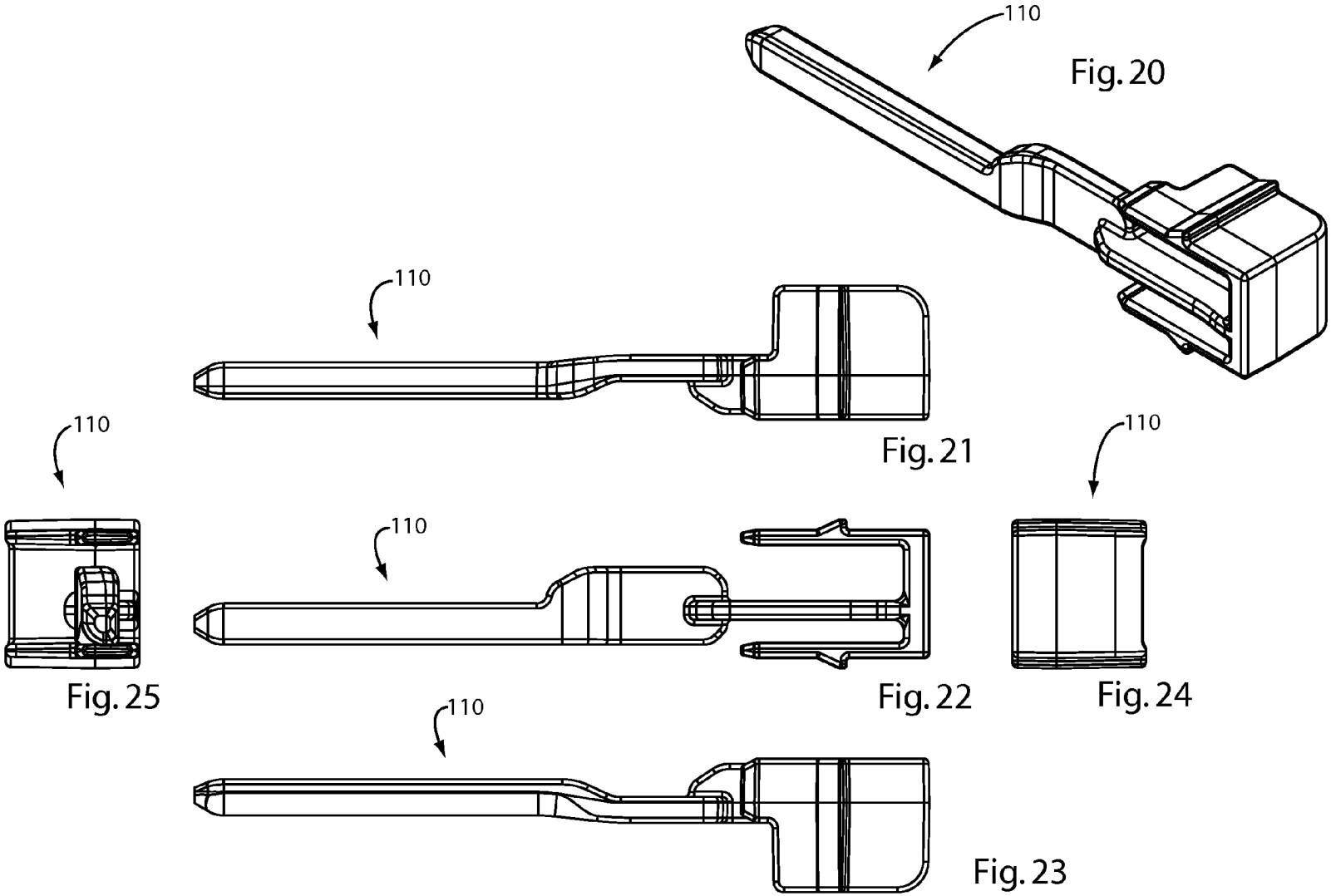

In latching, the striker 130 is bought into to position to the pawl throat 132 and begins to rotate the pawl 106 back in to the latched position as the door 142 is moved to the closed position illustrated in FIG. 11. As the pawl 106 rotates, the inner cam profile 144 of the pawl 106 flexes the lock bar 110 back toward the center of pawl 106 until it can spring back behind and into engagement with the step 134 in order to secure and maintain the pawl 106, the striker 130 and the door 142 in their latched or closed positions. The button 104 does not move during this operation. The striker 130 is again constrained by the pawl 106 and housing tower 122.

Note, an alternative design uses grommets installed in the housing 102 in lieu of the O-rings 114, 136 on the button 104, Functionally, it is very similar except that the hard points are now on the button 104 rather than the housing 102. On opening, the button 104 would impact on the grommet to reduce noise and on closing the Push studs 116 in the button 104 would dead-stop against the grommet.

The Second Embodiment

Operation of embodiment 300 is very similar to that of embodiment 100. Pressing the button 304 flexes the lock bar 310 towards the center, i.e. the axis of rotation, of the pawl 306 allowing the pawl 306 to move to the unlatched position. The major differences between the latch 300 and the latch 100 are around alignment features and spring usage. The latch 300 has a larger contact area internally to help guide the button 304 more linearly and side "living" springs 346 are included on the button carrier 348 to better constrain and center the button face plate 350 within the housing 302.

The latch 300 also makes use of torsion springs 312 internally in lieu of the compression springs 112 of the latch 100. This was done to help alleviate potential noise issues. There are no sound-deadening features present on the latch 300.

The latch 300 incorporates improvements in the alignment features by increasing the side arms 318, 326 on the button carrier 348 and introducing "living" springs 346 on the side of the carrier 348 to better center the button 304 in the housing 302. The compression springs 112 in the button area were replaced with torsion springs 312 to limit noise issues. The button 304 was also made in two pieces, a carrier 348 and a face plate 350, to provide for more control/variation of the geometry and the aesthetic design of the face plate while still being able to use the same internal parts for the button 304. This reduces the tooling costs involved in changes in the aesthetic design of the face plate 350.

The pawl throat 332 was also rotated relative to the pawl throat 132 of the latch 100 to reorient the direction of rectilinear motion of the button 304 relative to the direction of the relative motion of the striker 130, 330 upon opening of the door 142, 342 depending upon application requirements. The function remains similar in that the lock bar 310 is internal to the pawl 306 and releases the pawl 306 by moving or flexing towards the center of the pawl 306.

The present invention is not limited to the embodiments described above, but is understood to encompass all embodiments within the scope of the appended claims and their equivalents.

The invention claimed is:

1. A rotary pawl latch comprising:

a housing;

means for actuating the latch;

a pawl supported by said housing for rotary movement about an axis of rotation between a latched position and an unlatched position, said pawl having a step;

a spring biasing said pawl toward said unlatched position; and a lock bar supported by said housing, said lock bar engaging said step to maintain said pawl in said latched position;

wherein when the latch is actuated, said lock bar is moved toward said axis of rotation of said pawl to move said lock bar out of engagement with said step so that said pawl can begin to rotate toward said unlatched position;

wherein said pawl has a lock bar slot having an inner cam profile, said inner cam profile has a shape such that said lock bar is allowed to return to its unloaded state when said pawl is in said unlatched position; and wherein when the latch is actuated by said means for actuating the latch, said means for actuating the latch acts to flex said lock bar toward said axis of rotation of said pawl to move said lock bar out of engagement with said step so that said pawl can begin to rotate toward said unlatched position.

2. The rotary pawl latch according to claim 1, wherein said means for actuating the latch is selected from a group consisting of a handle and a button.

3. The rotary pawl latch according to claim 2, wherein said lock bar is in its unloaded state when said lock bar is securing said pawl in its latched position.

4. The rotary pawl latch according to claim 2, wherein said means for actuating the latch is a button.

5. The rotary pawl latch according to claim 4, wherein said button must be released for said pawl to finish rotating to said unlatched position.

6. The rotary pawl latch according to claim 5, wherein said button is provided with integrated guide rails to guide movement of said button.

7. The rotary pawl latch according to claim 6, wherein said button is provided with living springs to center said button within said housing.

8. The rotary pawl latch according to claim 6, further comprising living springs to center said button within said housing.

9. The rotary pawl latch according to claim 5, wherein said button is provided with living springs to center said button within said housing.

10. The rotary pawl latch according to claim 5, further comprising living springs to center said button within said housing.

11. The rotary pawl latch according to claim 4, wherein said button is provided with integrated guide rails to guide movement of said button.

12. The rotary pawl latch according to claim 11, wherein said button is provided with living springs to center said button within said housing.

13. The rotary pawl latch according to claim 11, further comprising living springs to center said button within said housing.

14. The rotary pawl latch according to claim 4, wherein said button is provided with living springs to center said button within said housing.

15. The rotary pawl latch according to claim 4, further comprising living springs to center said button within said housing.

16. The rotary pawl latch according to claim 1, wherein said lock bar is in its unloaded state when said lock bar is securing said pawl in its latched position.

17. A rotary pawl latch comprising:

a housing;

a button for actuating the latch, said button being depressed to a depressed position to actuate the latch, said button traveling rectilinearly inward relative to said housing when being depressed;

a pawl supported by said housing for rotary movement about an axis of rotation between a latched position and an unlatched position, said pawl having a lock bar slot and a step provided in said lock bar slot;

a spring biasing said pawl toward said unlatched position; and a lock bar supported by said housing, said lock bar engaging said step to maintain said pawl in said latched position, said lock bar being positioned to extend through said lock bar slot of said pawl at all times during operation of the rotary pawl latch;

wherein when the latch is actuated said button engages said lock bar to flex said lock bar toward said axis of rotation of said pawl to move said lock bar out of engagement with said step so that said pawl can begin to rotate toward said unlatched position.

* * * * *